US008944649B2

(12) United States Patent
Fedosik et al.

(10) Patent No.: US 8,944,649 B2
(45) Date of Patent: Feb. 3, 2015

(54) VEHICLE HEADLIGHT

(75) Inventors: Dmitry Fedosik, Jena (DE); Wolfram Wintzer, Jena (DE)

(73) Assignee: Doctor Optics SE (DE)

( * ) Notice: Subject to any disclaimer, the term of this patent is extended or adjusted under 35 U.S.C. 154(b) by 2 days.

(21) Appl. No.: 13/990,095

(22) PCT Filed: Nov. 11, 2011

(86) PCT No.: PCT/EP2011/005703

§ 371 (c)(1),
(2), (4) Date: May 29, 2013

(87) PCT Pub. No.: WO2012/072193

PCT Pub. Date: Jun. 7, 2012

(65) Prior Publication Data

US 2013/0242590 A1 Sep. 19, 2013

(30) Foreign Application Priority Data

| | | |
|---|---|---|
| Dec. 3, 2010 | (DE) | 10 2010 053 185 |
| Feb. 1, 2011 | (DE) | 10 2011 009 950 |
| Jul. 11, 2011 | (DE) | 10 2011 107 058 |

(51) Int. Cl.
*F21V 9/00* (2006.01)
*F21S 8/10* (2006.01)

(52) U.S. Cl.
CPC ..... *F21S 48/12* (2013.01); *F21S 48/1159* (2013.01); *F21S 48/1163* (2013.01); *F21S 48/1241* (2013.01); *F21S 48/1266* (2013.01); *F21S 48/1275* (2013.01)
USPC ..... 362/511; 362/520; 362/521; 362/522; 362/523

(58) Field of Classification Search
USPC ..... 362/511, 520–523
See application file for complete search history.

(56) References Cited

U.S. PATENT DOCUMENTS

| | | | | |
|---|---|---|---|---|
| 5,257,168 | A | 10/1993 | Davenport et al. | |
| 5,697,690 | A | 12/1997 | Okuchi et al. | |
| 6,709,141 | B1 | 3/2004 | Sisti | |
| 7,073,931 | B2 | 7/2006 | Ishida | |
| 8,342,726 | B2 | 1/2013 | Fischer et al. | |
| 2004/0156209 | A1* | 8/2004 | Ishida | 362/516 |
| 2006/0083013 | A1* | 4/2006 | Wanninger et al. | 362/509 |
| 2006/0087860 | A1 | 4/2006 | Ishida | |
| 2007/0147055 | A1 | 6/2007 | Komatsu | |
| 2007/0201241 | A1 | 8/2007 | Komatsu | |

(Continued)

FOREIGN PATENT DOCUMENTS

| | | | |
|---|---|---|---|
| DE | 1165514 | B | 9/1964 |
| DE | 4121673 | A1 | 1/1993 |

(Continued)

OTHER PUBLICATIONS

PCT International Search Report completed by the ISA/EP on Feb. 1, 2012 and issued in connection with PCT/EP2011/005698.

(Continued)

*Primary Examiner* — Sean Gramling
(74) *Attorney, Agent, or Firm* — Barnes & Thornburg LLP

(57) ABSTRACT

An arrangement of headlight lenses for a vehicle headlight, each headlight lens having a monolithic body of transparent material, which monolithic body includes at least one light entry face, a light passage section and at least one optically operative light exit face.

19 Claims, 13 Drawing Sheets

(56) References Cited

U.S. PATENT DOCUMENTS

| | | | |
|---|---|---|---|
| 2010/0033849 | A1 | 2/2010 | Seki et al. |
| 2011/0148280 | A1 | 6/2011 | Kishimoto et al. |

FOREIGN PATENT DOCUMENTS

| | | | |
|---|---|---|---|
| DE | 4209957 | A1 | 9/1993 |
| DE | 4320554 | A1 | 12/1993 |
| DE | 19526512 | A1 | 1/1996 |
| DE | 19742159 | A1 | 4/1998 |
| DE | 102005011760 | A1 | 9/2006 |
| DE | 102008026626 | A1 | 12/2009 |
| DE | 10252228 | B4 | 1/2010 |
| DE | 102008049168 | A1 | 4/2010 |
| DE | 102009008631 | A1 | 8/2010 |
| EP | 1113216 | A2 | 7/2001 |
| EP | 1357334 | A1 | 10/2003 |
| EP | 1666787 | A1 | 6/2006 |
| EP | 1767398 | A1 | 3/2007 |
| EP | 2113222 | A1 | 11/2009 |
| EP | 2159479 | A2 | 3/2010 |
| EP | 2221219 | A1 | 8/2010 |
| FR | 2860280 | A1 | 9/2004 |
| GB | 2365962 | A | 2/2002 |
| GB | 2399622 | B | 8/2005 |
| GB | 2412159 | A | 9/2005 |
| JP | 2005317226 | | 11/2005 |
| WO | 2009/147070 | A1 | 12/2009 |

OTHER PUBLICATIONS

PCT International Search Report completed by the ISA/EP on Mar. 19, 2012 and issued in connection with PCT/EP2011/005699.
PCT International Search Report completed by the ISA/EP on Feb. 15, 2012 and issued in connection with PCT/EP2011/005700.
PCT International Search Report completed by the ISA/EP on Feb. 1, 2012 and issued in connection with PCT/EP2011/005701.
PCT International Search Report completed by the ISA/EP on May 9, 2012 and issued in connection with PCT/EP2011/005702.
PCT International Search Report completed by the ISA/EP on May 4, 2012 and issued in connection with PCT/EP2011/005703.
International Preliminary Report on Patentability (Chapter I) issued on Jun. 4, 2013 in connection with PCT/EP2011/005698.
International Preliminary Report on Patentability (Chapter I) issued on Jun. 4, 2013 in connection with PCT/EP2011/005699.
International Preliminary Report on Patentability (Chapter I) issued on Jun. 4, 2013 in connection with PCT/EP2011/005700.
International Preliminary Report on Patentability (Chapter I) issued on Jun. 4, 2013 in connection with PCT/EP2011/005701.
International Preliminary Report on Patentability (Chapter I) issued on Jun. 4, 2013 in connection with PCT/EP2011/005702.
International Preliminary Report on Patentability (Chapter I) issued on Jun. 4, 2013 in connection with PCT/EP2011/005703.

* cited by examiner

Fig. 10
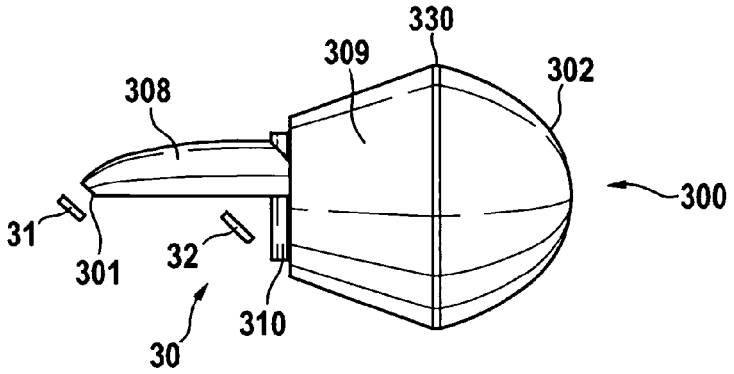
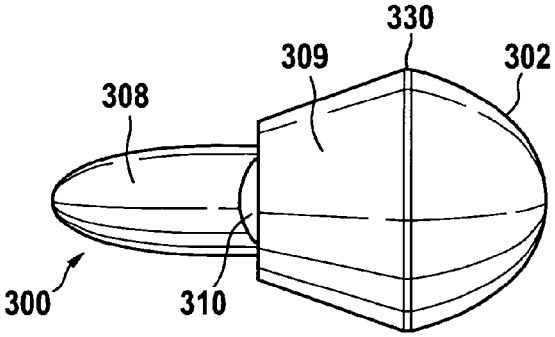
Fig. 11
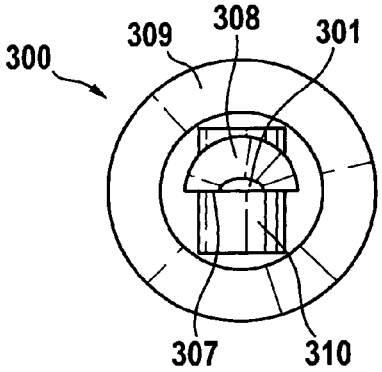
Fig. 12
Fig. 13
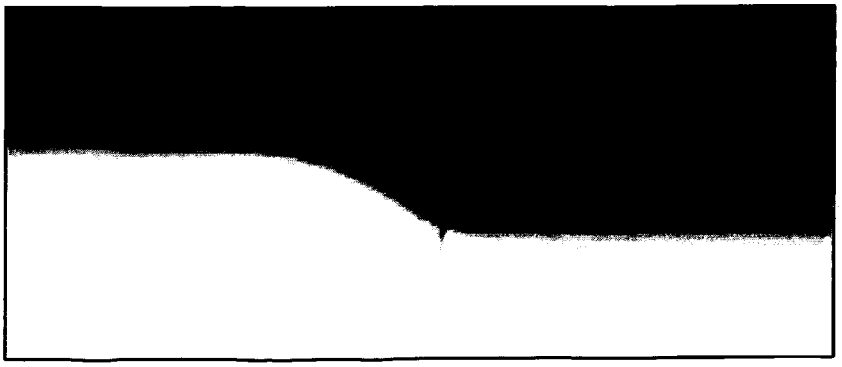

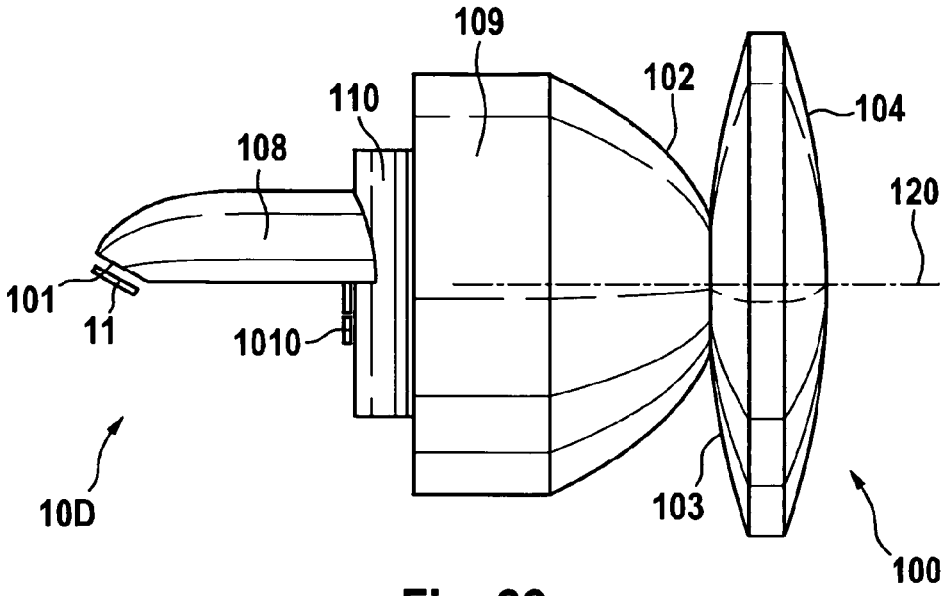
Fig. 22
Fig. 23
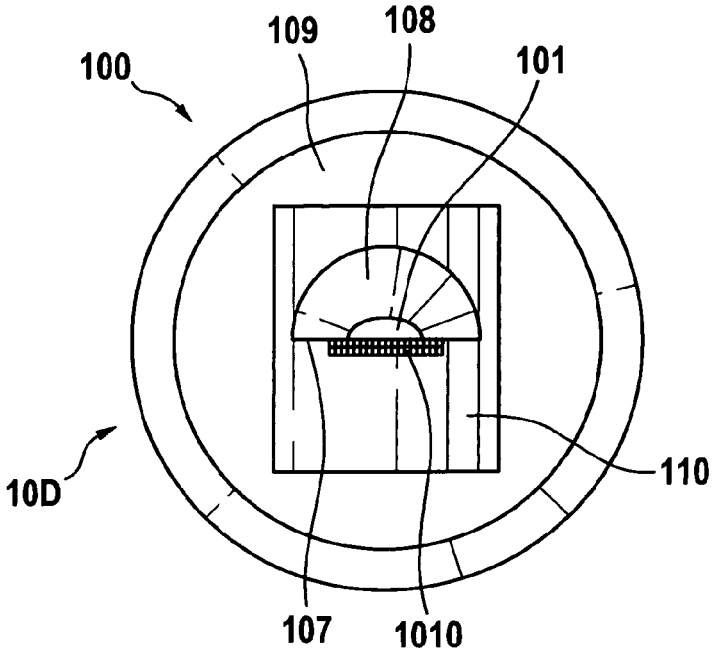

VEHICLE HEADLIGHT

CROSS-REFERENCE TO RELATED APPLICATIONS

This application is the U.S. national phase of PCT/EP2011/005703 filed Nov. 11, 2011. PCT/EP2011/005703 claims the benefit under the Convention of German Patent Application Nos. 10 2010 053 185.5, 10 2011 009 950.6, and 10 2011 107 058.7 filed Dec. 3, 2010, Feb. 1, 2011, and Jul. 11, 2011 (respectively).

FIELD OF THE INVENTION

The invention relates to a vehicle headlight including a headlight lens, which has a monolithic body of transparent material including at least one light entry face and at least one optically operative (also to be construed as 'effective') light exit face

BACKGROUND INFORMATION

DE 203 20 546 U1 discloses a lens blank—molded on both sides and having a curved surface, a planar surface and a retention edge integrally molded on the lens edge, wherein a supporting edge of a thickness of at least 0.2 mm and projecting with respect to the planar surface is integrally formed on the retention edge. Herein, the supporting edge is integrally formed on the outer circumference of the headlight lens. A further headlight lens having a supporting edge is disclosed e.g. by DE 10 2004 048 500 A1.

DE 20 2004 005 936 U1 discloses a lens for illuminating purposes, notably a lens for a headlight for imaging light emitted from a light source and reflected by a reflector for generating a predetermined illumination pattern, said lens having two opposing surfaces, wherein areas of different optical dispersion effects are provided on at least a first surface.

DE 103 15 131 A1 discloses a headlight for vehicles having at least one extensive luminous field including a plurality of illuminating element (diode)-chips and an optical element arranged in the light path of the light beam emitted by the luminous field, wherein the illuminating element chips of the luminous field are arranged in a common recess, and that the recess, on a side facing the direction of light emission, has an outer edge which, in relation to the elimination element chips, is spatially arranged such that a predetermined gradient of light density is formed in a light dispersion of the headlight in the area of the outer edges.

DE 10 2004 043 706 A1 discloses an optical system for a motor vehicle headlight for dispersing a beam of light rays from an illuminant, with an optical primary element having an optical face including a break or discontinuity extending along a line, being provided, wherein the optical face is formed smooth at least on one side adjacent the discontinuity so that the beam of light rays is separated into two partial beams of light rays. Herein, it is provided that at least one of the partial beams of light rays has a sharp edge of limitation. Moreover, the optical system comprises an optical secondary element for imaging the sharp edge of limitation on to a predetermined light-dark-boundary (also known as "bright-dark-boundary").

EP 1 357 333 A2 discloses a light source device for a vehicle light which has an element emitting semiconductor light, which element is arranged on an optical axis of the light source device and emits its light essentially in an orthogonal direction with regard to the optical axis.

Further illumination of actions in context with the vehicles are disclosed by DE 42 09 957 A1, DE 41 21 673 A1, DE 43 20 554 A1, DE 195 26 512 A1, DE 10 2009 008 631 A1, U.S. Pat. No. 5,257,168 and U.S. Pat. No. 5,697,690.

It is, in particular, an object of the invention to suggest an improved headlight lens for a vehicle headlight, in particular for a motor vehicle headlight. It is a further object of the invention to reduce the costs for manufacturing vehicle headlights. It is a further object of the invention to reduce the costs for manufacturing vehicles. It is a still further object of the invention to suggest a vehicle having particularly compact dipped-beam headlights.

SUMMARY

The aforementioned object is achieved by a vehicle headlight, in particular a motor vehicle headlight, the vehicle headlight comprising:

a first light source;

at least one second light source;

a first headlight lens (associated with the first light source), which comprises a particularly blank—molded monolithic body of transparent material, wherein the monolithic body comprises at least one light tunnel and one light passage section (light conductive section') having at least one optically operative light exit (sur)face, wherein the light tunnel comprises at least one particularly optically operative light entry (sur)face and (in particular for implementing dipped-beam headlights), via a bend, passes over (also to be construed as "transits" or "forms a transition") into the light passage section for imaging (mapping) the bend as a light(bright)-dark-boundary by means of light made to enter (also to be construed as "coupled") or irradiated, respectively, from the first light source into the light entry face of the first headlight lens; and at least one second headlight lens (associated with the second light source), which comprises a particularly blank—molded monolithic body of transparent material, wherein the monolithic body comprises at least one light tunnel and a light passage (conductive) section having at least one optically operative light exit face, wherein the light tunnel comprises at least one, particularly optically operative light entry face and (in particular for implementing dipped-beam headlights), via a bend, passes over into the light passage section for imaging the bend as a light-dark-boundary by means of light made to enter or irradiated, respectively, from the first light source into the light entry face of the second headlight lens, wherein the second headlight lens comprises an optical axis which is inclined, with respect to the optical axis of the first headlight lens, in particular by at least 0.5°, in particular by at least 4°.

An optically operative (effective) light entry (sur)face or an optically operative (effective) light exit (sur)face, respectively, is (constituted by) an optically operative (effective) face of the monolithic body. In the sense of the invention, an optically operative surface is in particular a surface of the transparent body, at which surface, when using the headlight lens according to its purpose light will be refracted. In the sense of the invention, an optically operative (sur)face is in particular a surface at which, when using the headlight lens according to its purpose, the direction of light which passes through this service will be changed.

In the sense of the invention, transparent material is particularly glass. In the sense of the invention, transparent material is particularly inorganic glass. In the sense of the invention, transparent material is particularly silicate glass. In the sense of the invention, transparent material is particularly glass as described in Document PCT/EP2008/010136. In the sense of the invention, glass particularly comprises 0.2 to 2% by weight $Al_2O_3$
0.1 to 1% by weight $Li_2O$,
0.3 (in particular 0.4) to 1.5% by weight $Sb_2O_3$
60 to 75% by weight $SiO_2$,
3 to 12% by weight $Na_2O$,
3 to 12% by weight $K_2O$, and
3 to 12% by weight CaO.

In the sense of the invention, the term blank molding is, in particular, to be understood in a manner that an optically operative surface is to be molded under pressure such that any subsequent finishing or post-treatment of the contour of this optically operative surface may be dispensed with or does not apply or will not have to be provided for, respectively. Consequently, it is particularly provided for that, after blank-molding, the light exit face is not ground, i.e. it will not be treated by grinding.

In the sense of the invention a light tunnel is in particular characterized in that, taken essentially, total reflection occurs at its lateral (in particular upper, lower, right and or left) surfaces, so that light entering the light entry face is guided through the tunnel as a light guide. In the sense of the invention a light tunnel is in particular a light guide or light conductor. In particular, it is provided for that total reflection is to occur on the longitudinal surfaces of the light tunnel. In particular, it is provided for that the longitudinal surfaces of the light tunnel are adapted for total reflection. In particular, it is provided for that total reflection is to occur at the surfaces of the light tunnel essentially oriented in the direction of the optical axis of the light tunnel. In particular, it is provided for that the surfaces of the light tunnel essentially oriented in the direction of the optical axis of the light tunnel are adapted for total reflection. A light tunnel, in the sense of the invention, in particular tapers in the direction of its light entry face. A light tunnel, in the sense of the invention, in particular tapers in the direction towards its light entry face by at least 3°. A light tunnel, in the sense of the invention, in particular tapers in the direction towards its light entry face by at least 3° with respect to its optical axis. A light tunnel, in the sense of the invention, in particular tapers at least partially in the direction towards its light entry face. A light tunnel, in the sense of the invention, in particular tapers at least partially in the direction towards its light entry face by at least 3°. A light tunnel, in the sense of the invention, in particular tapers at least partially in the direction towards its light entry face by at least 3° with respect to its optical axis.

A bend, in the sense of the invention, is, in particular, a curved transition. A bend, in the sense of the invention, is, in particular, a curved transition having a radius of curvature of no less than 50 nm. It is, in particular, provided for that the surface of the headlight lens has no break or discontinuity in the bend, but is rather in the shape of a curve or curvature. It is, in particular, provided for that the surface of the headlight lens in the bend has a curvature, in particular with a radius of curvature of the curve in the bend of no less than 50 nm. In an embodiment the radius of curvature is no larger than 5 mm (e.g. for implementing fog light). In an expedient embodiment the radius of curvature is no more than 0.25 mm (e.g. for implementing dipped-beam headlight), in particular no more than 0.15 mm, in particular no more than 0.1 mm. In another embodiment of the invention, the radius of curvature of the curve in the bend is at least 0.05 mm. It is, in particular, provided for that the surface of the headlight lens is blank-molded in the region of the bend.

The distance between the first light source and the first headlight lens (associated with the first light source) amounts to particularly less than 1 cm. It is, in particular, provided for that the first light source and the first headlight lens (associated with the first light source) are integrated in a mutual housing or in mutual retention means. It is, in particular, provided for that the first light source and the first headlight lens (associated with the first light source) or the mutual housing or the mutual retention means, respectively, is/are integrated, within the central third of the front of the motor vehicle, in the body of the motor vehicle, or that the mutual housing or the mutual retention means is/are integrated within the central third of the front bumper, respectively.

The distance between the second light source and the second headlight lens (associated with the second light source) amounts to particularly less than 1 cm. It is, in particular, provided for that the second light source and the second headlight lens (associated with the second light source) are integrated in a mutual housing or in mutual retention means. It is, in particular, provided for that the second light source and the second headlight lens (associated with the second light source) or the mutual housing or the mutual retention means, respectively, is/are integrated, within the central third of the front of the motor vehicle, in the body of the motor vehicle, or that the mutual housing or the mutual retention means is/are integrated within the central third of the front bumper, respectively.

In a further expedient embodiment of the invention the optical axis of the first headlight lens extends in a (essentially) horizontal plane. In another embodiment of the invention the optical axis of the second headlight lens extends in a (essentially) horizontal plane.

In another embodiment of the invention the vehicle headlight comprises at least one third light source and one third headlight lens (associated with the third light source), which comprises a particularly blank-molded monolithic body of transparent material, wherein the monolithic body comprises at least one light tunnel and one light passage section having at least one optically operative light exit face, wherein the light tunnel comprises at least one, particularly optically effective light entry face, and (in particular for implementing dipped-beam headlights), via a bend, passes over or transits into the light passage section for imaging the bend as a light-dark-boundary by means of light made to enter (coupled) or irradiated, respectively, from the third light source into the light entry face of the third headlight lens, and wherein the third headlight lens comprises an optical axis which is inclined, with respect to the optical axis of the first headlight lens and/or with respect to the optical axis of the second headlight lens, in particular by at least 0.5°, in particular by at least 4°. In a further expedient embodiment of the invention the optical axis of the third headlight lens extends in a (essentially) horizontal plane.

The distance between the third light source and the third headlight lens (associated with the third light source) amounts to particularly less than 1 cm. It is, in particular, provided for that the third light source and the third headlight lens (associated with the third light source) are integrated in a mutual housing or in mutual retention means. It is, in particular, provided for that the third light source and the third headlight lens (associated with the third light source) or the mutual housing or the mutual retention means is/are integrated, within the central third of the front of the motor vehicle, in the body of the motor vehicle, or that the mutual housing or the mutual retention means is/are integrated within the central third of the front bumper, respectively.

In another embodiment of the invention the vehicle headlight comprises at least one fourth light source and one fourth headlight lens (associated with the fourth light source), which comprises a particularly blank-molded monolithic body of transparent material, wherein the monolithic body comprises at least one light tunnel and one light passage section having at least one optically operative light exit face, wherein the light tunnel comprises at least one in particular optically operative light entry face and, via a bend (in particular for implementing dipped-beam headlight), passes over into the light passage section for imaging the bend as a light-dark-boundary by means of light made to enter (coupled) or irradiated, respectively, from the fourth light source into the light entry face of the fourth headlight lens, and wherein the fourth headlight lens comprises an optical axis which is inclined, with respect to the optical axis of the first headlight lens and/or with respect to the optical axis of the second headlight lens, in particular by at least 0.5°, in particular by at least 4° and/or with respect to the optical axis of the third headlight lens, in particular by at least 0.5°, in particular by at least 4°. In a further expedient embodiment of the invention the optical axis of the fourth headlight lens extends in a (essentially) horizontal plane.

The distance between the fourth light source and the fourth headlight lens (associated with the fourth light source) amounts to particularly less than 1 cm. It is, in particular, provided for that the fourth light source and the fourth headlight lens (associated with the fourth light source) are integrated in a mutual housing or in mutual retention means. It is, in particular, provided for that the fourth light source and the fourth headlight lens (associated with the fourth light source) or the mutual housing or the mutual retention means, respectively, is/are integrated, within the central third of the front of the motor vehicle, in the body of the motor vehicle, or that the mutual housing or the mutual retention means is/are integrated within the central third of the front bumper, respectively.

In another embodiment of the invention the (first, second, third, and/or fourth) light source and the (first, second, third, and/or fourth) light entry face are configured and associated with each other such that light from the (first, second, third, and/or fourth) light source enters the (first, second, third, and/or fourth) light entry face at a luminous flux density of at least 75 $lm/mm^2$.

In another embodiment of the invention, there have been integrated, in the right quarter of the bumper at least one light source and at least one headlight lens associated with this light source, in the bumper, wherein it is in particular provided for that the headlight lens comprises a particularly blank-molded monolithic body of transparent material, wherein the monolithic body comprises at least one light tunnel and one light passage (light conductive) section having at least one optically effective (operative) light entry face, wherein the light tunnel comprises at least one, in particular optically effective (operative) light entry face and, via a bend, passes over into the light passage section for imaging the bend as a light-dark-boundary by means of light made to enter or irradiated, respectively, from this light source into the light entry face of the headlight lens. It is, in particular, provided for that this light source and this headlight lens are integrated in a mutual housing or in a mutual retention means. It is, in particular, provided for that the mutual housing or the mutual retention means, respectively, is/are integrated in the right quarter of the bumper or in the right quarter of the front of the motor vehicle.

In another embodiment of the invention, there have been integrated, in the left quarter of the bumper, at least one light source and at least one headlight lens associated with this light source in the bumper, wherein it is in particular provided for that the headlight lens comprises an in particular blank-molded, monolithic body of transparent material, wherein the monolithic body comprises at least one light tunnel and one light passage section having at least one optically effective (operative) light exit face, wherein the light tunnel comprises at least one, in particular optically effective (operative) light entry face and, via a bend, passes over (transits) into the light passage section for imaging the bend as a light-dark-boundary by means of light from this light source made to enter (coupled) or irradiated, respectively, into the light entry face of the headlight lens. It is, in particular, provided for that this light source and this headlight lens are integrated in a mutual housing or in a mutual retention means. It is, in particular, provided for that the mutual housing or the mutual retention means is/are integrated in the left quarter of the bumper or in the left quarter of the front of the motor vehicle, respectively.

In another embodiment of the invention, there have been integrated, in the right quarter of the front of the motor vehicle at least one light source in the body of the motor vehicle and at least one headlight lens associated with this light source in the bumper, wherein it is in particular provided for that the headlight lens comprises an in particular blank-molded, monolithic body of transparent material, wherein the monolithic body comprises at least one light tunnel and one light passage section having at least one optically effective (operative) light exit face, wherein the light tunnel comprises at least one, in particular optically effective (operative) light entry face and, via a bend, transits into the light passage section for imaging the bend as a light-dark-boundary by means of light from this light source coupled or irradiated, respectively, into the light entry face of the headlight lens. It is, in particular, provided for that this light source and this headlight lens are integrated into a mutual housing or in mutual retention means. It is, in particular, provided for that the mutual housing or the mutual retention means is/are integrated, within the right quarter of the front of the motor vehicle, in the body of the motor vehicle.

In another embodiment of the invention, there have been integrated, in the left quarter of the front of the motor vehicle at least one light source in the body of the motor vehicle and at least one headlight lens associated with this light source in the bumper, wherein it is in particular provided for that the headlight lens comprises an in particular blank-molded, monolithic body of transparent material, wherein the monolithic body comprises at least one light tunnel and one light passage (light conductive) section having at least one optically operative light exit face, wherein the light tunnel comprises at least one, in particular optically operative light entry face and, via a bend, transits into the light passage section for imaging the bend as a light-dark-boundary by means of light from this light source made to enter or irradiated, respectively, into the light entry face of the headlight lens. It is, in particular, provided for that this light source and this headlight lens are integrated in a mutual housing or in mutual retention means. It is, in particular, provided for that the mutual housing or the mutual retention means is/are integrated, within the left quarter of the front of the motor vehicle, in the body of the motor vehicle.

It is, in particular, provided for that at least 40%, particularly at least 50% of the light output/power of dipped-beam headlight is emitted by means of headlight lenses which are arranged in the central third of the front bumper or in the central third of the front of the motor vehicle.

In particular, there may be provided up to seven headlight lenses which are arranged in the central third of the front bumper or in the central third of the front of the motor vehicle.

In another embodiment of the invention the light tunnel is arranged between the bend and the light entry face. In another embodiment of the invention the light passage section is arranged between the bend and the light exit face. In particular, it is provided for that light, which enters the transparent body through the light entry face and enters the passage section from the light tunnel in the area of the bend, will exit from the light exit face at an angle of between −20° and 20° with regard to the optical axis. In particular, it is provided for that light which enters the transparent body through the light entry face will exit from the light exit face at an angle of between −20° and 20° with regard to the optical axis. In particular, it is provided for that light which enters the transparent body through the light entry face and enters the passage section from the light tunnel in the area of the bend, will exit from the light exit face essentially in parallel to the optical axis. It is, in particular, provided for that light, which enters the transparent body through the light entry face will exit from the light exit face essentially in parallel to the optical axis.

In another embodiment of the invention the bend includes an opening angle of at least 90°. In a further expedient embodiment of the invention the bend includes an opening angle of no more than 150°. In a further favourable embodiment of the invention the bend is arranged on a surface of the light passage section, which surface is facing the light entry face.

In another embodiment of the invention the orthogonal of the light entry face is inclined with respect to the optical axis of the light passage section. In a further expedient embodiment of the invention the light entry face is inclined with respect to the optical axis of the light passage section at an angle of between 5° and 70°, in particular at an angle of between 20° and 50°.

In another embodiment of the invention the light tunnel comprises a region on its surface which corresponds essentially to a part of the surface of an ellipsoid. In a further expedient embodiment of the invention the light tunnel comprises a region on its surface which corresponds essentially to at least 15% of the surface of an ellipsoid.

In another embodiment of the invention the light tunnel comprises a region on its surface, for which the following applies:

$$0,75\cdot a\cdot\sqrt{1-\frac{y^2}{b^2}-\frac{z^2}{c^2}}\le x\le 1,25\cdot a\cdot\sqrt{1-\frac{y^2}{b^2}-\frac{z^2}{c^2}}$$

$$0,75\cdot b\cdot\sqrt{1-\frac{x^2}{a^2}-\frac{z^2}{c^2}}\le y\le 1,25\cdot b\cdot\sqrt{1-\frac{x^2}{a^2}-\frac{z^2}{c^2}},$$

in which z is a coordinate in the direction (of the optical axis) of the light tunnel;

x is a coordinate orthogonal to the direction of the optical axis of the light tunnel;

y is a coordinate orthogonal to the direction of the optical axis of the light tunnel;

a is a number having a value greater than 0;

b is a number having a value greater than 0; and c is a number having a value greater than 0.

In another embodiment of the invention a surface of the light passage section facing the light tunnel is curved at least in the region of the bend to the transition into the light tunnel, the curvature being, in particular, convex. In another embodiment of the invention the bend is curved in its longitudinal extension. In another embodiment of the invention the bend is curved, in its longitudinal extension, having a radius of curvature of between 5 mm and 100 mm. In another embodiment of the invention the bend is curved, in its longitudinal extension, according to a Petzval curvature (also termed Petzval surface).

In a further expedient embodiment of the invention the bend comprises, in its longitudinal extension, a curvature having a radius of curvature in the orientation of the optical axis of the light tunnel and/or of the light passage section. In another embodiment of the invention the radius of curvature is orientated opposite to the light exit face.

In another embodiment of the invention the bend is curved in a first direction and in a second direction. In a further expedient embodiment of the invention the first direction is orthogonal to the second direction. In another embodiment of the invention the bend is curved with a first radius of curvature in a first direction and with a second radius of curvature in a second direction, wherein the second radius of curvature is positioned orthogonal to the first radius of curvature.

In another embodiment a portion of the surface of the passage section facing the light tunnel is configured as a Petzval face. In another embodiment of the invention the surface of the light passage section facing the light tunnel is, in a region in which it forms a transition into the light tunnel, configured as a Petzval face.

In another embodiment of the invention the length of the headlight lens, when viewed in the orientation of the optical axis of the light tunnel and/or the light passage section, amounts to no more than 7 cm.

In another embodiment of the invention the headlight lens or the transparent body, respectively, has a further light exit face as well as a further light entry face. In a further expedient embodiment of the invention at least 20% of the light entering the light entry face and exiting through the light exit face will exit through the light exit face after having exited from the monolithic body through the further light exit face and having entered the monolithic body through the further light entry face. In another embodiment of the invention at least 10%, in particular at least 20% of the light entering the light entry face and exiting through the light exit face will exit through the light exit face without having exited from the monolithic body through the further light exit face and without having entered the monolithic body through the further light entry face. In a yet further expedient embodiment of the invention at least 75% of the light entering the light entry face and exiting through the light exit face will exit through the light exit face after having exited from the monolithic body through the further light exit face and having entered the monolithic body through the further light entry face. In another embodiment of the invention it is provided for that light which enters the transparent body through the light entry face and enters the passage section from the light tunnel in the region of the bend will either exit from the monolithic body from the further light exit face and enter the further light entry face of the monolithic body as well as it will exit from the monolithic body from the light exit face, or it will exit directly from the light exit face (without exiting from the monolithic body through the further light exit face and entering the further light entry face of the monolithic body).

In a further expedient embodiment of the invention the vehicle headlight has no secondary optic associated with the headlight lens. A secondary optic, in the sense of the invention, is in particular an optic for aligning light which exits from the light exit face or from the last light exit face, respectively. A secondary optic, in the sense of the invention, is in particular an optical element for aligning light separated from and/or subordinated with regard to the headlight lens. A secondary optic, in the sense of the invention, is in particular no cover or protection disc, respectively, but an optical element provided for aligning light. An example of a secondary optic is e.g. a secondary lens as has been disclosed in DE 10 2004 043 706 A1.

In particular, there is provided that the bend which is mapped as light-dark-boundary lies in the lower region of the light tunnel.

In another embodiment of the invention the distance of the light source from the centre of the light exit face, when seen in the orientation of the optical axis of the light tunnel and/or the light passage section amounts to no more than 10 cm. In another embodiment of the invention the length of the vehicle headlight, when seen in the orientation of the optical axis of the light tunnel and/or the light passage section amounts to no more than 10 cm.

In a further expedient embodiment of the invention a further light source for making light enter or irradiating light, respectively, into the light tunnel and/or immediately/directly into the light passage section is associated with the first headlight lens and/or the second headlight lens and/or at least one of the headlight lenses. In a further expedient embodiment of the invention a further light source for making light enter (be coupled) or irradiating light, respectively, into a surface of the light passage section facing the light tunnel, is associated with the first headlight lens and/or the second headlight lens and/or at least one of the headlight lenses. In a further expedient embodiment of the invention light is irradiated, by means of the further light source, above and/or below the light-dark-boundary.

In a furthermore expedient embodiment of the invention a corner light source, arranged, in particular, to the left of the optical axis of the light tunnel and/or above the optical axis of the light tunnel and/or of the light tunnel (as such) is associated with the first headlight lens and/or with the second headlight lens and/or with at least one of the headlight lenses. In a furthermore expedient embodiment of the invention a corner light source, arranged, in particular, to the right of the optical axis of the light tunnel and/or above the optical axis of the light tunnel and/or of the light tunnel (as such) is associated with the first headlight lens and/or with the second headlight lens and/or with at least one of the headlight lenses.

In another embodiment of the invention a partial light source, arranged above the light tunnel, is associated with the first headlight lens and/or with the second headlight lens and/or with at least one of the headlight lenses. In another embodiment of the invention at least two partial light sources, arranged above the light tunnel and spatially separated from one another, are associated with the first headlight lens and/or with the second headlight lens and/or with at least one of the headlight lenses. In another embodiment of the invention a partial light source, arranged below the light tunnel, is associated with the first headlight lens and/or with the second headlight lens and/or with at least one of the headlight lenses. In another embodiment of the invention at least two partial light sources, arranged below the light tunnel and spatially separated from one another, are associated with the first headlight lens and/or with the second headlight lens and/or with at least one of the headlight lenses.

In an embodiment of the invention a light source, a corner light source and/or a partial light source include/s at least one LED or an array of LEDs. In an expedient embodiment of the invention the light source comprises at least one OLED or an array of OLEDs. For example the light source may well be a plane luminous field. The light source may also include light element chips as have been disclosed by DE 103 15 131 A1. A light source may also be a laser. A suitable laser has been disclosed in ISAL 2011 Proceedings, page 271ff.

It may be provided for that a light entry face, in the sense of the invention, and/or a light exit face, in the sense of the invention, may have a light dispersing structure. A light dispersing structure, in the sense of the invention, may, for example, be a structure as has been disclosed in DE 10 2005 009 556 A1 and in EP 1 514 148 A1 or EP 1 514 148 B1. It may be provided for that a light tunnel, in the sense of the invention, is coated. It may be provided for that a light tunnel, in the sense of the invention, is coated with a reflective coating or layer. It may be provided for that, in the sense of the invention, a mirror-like reflective coating is applied to a light tunnel.

In the sense of the invention, a motor vehicle is, in particular, a land vehicle for individual use in road traffic. In the sense of the invention, motor vehicles are, in particular, not restricted to land vehicles including a combustion engine. A motor vehicle, in the sense of the invention, comprises, in particular, at least four wheels. A motor vehicle, in the sense of the invention, comprises, in particular, a seat for a driver and at least one front passenger seat arranged alongside the driver's seat seen in the transversal direction of the motor vehicle. A motor vehicle, in the sense of the invention, comprises, in particular, at least four seats. A motor vehicle, in the sense of the invention, is, in particular, admitted for at least four persons.

BRIEF DESCRIPTION OF THE DRAWINGS

FIG. 10 shows a side view of a further alternative example of embodiment of a motor vehicle headlight (for use in the motor vehicle according to FIG. 1);

FIG. 11 shows an example of embodiment of a headlight lens of the motor vehicle headlight according to FIG. 10 by way of a top view;

FIG. 12 shows the headlight lens according to FIG. 11 by way of a rear view;

FIG. 13 shows a bright-dark-boundary generated by means of the motor vehicle headlight according to FIG. 10;

FIG. 22 shows a side elevation of a further example of embodiment of a motor vehicle headlight for use in the motor vehicle according to FIG. 1;

FIG. 23 shows a view from the rear of the motor vehicle headlight according to FIG. 22;

DETAILED DESCRIPTION

Figure 1:
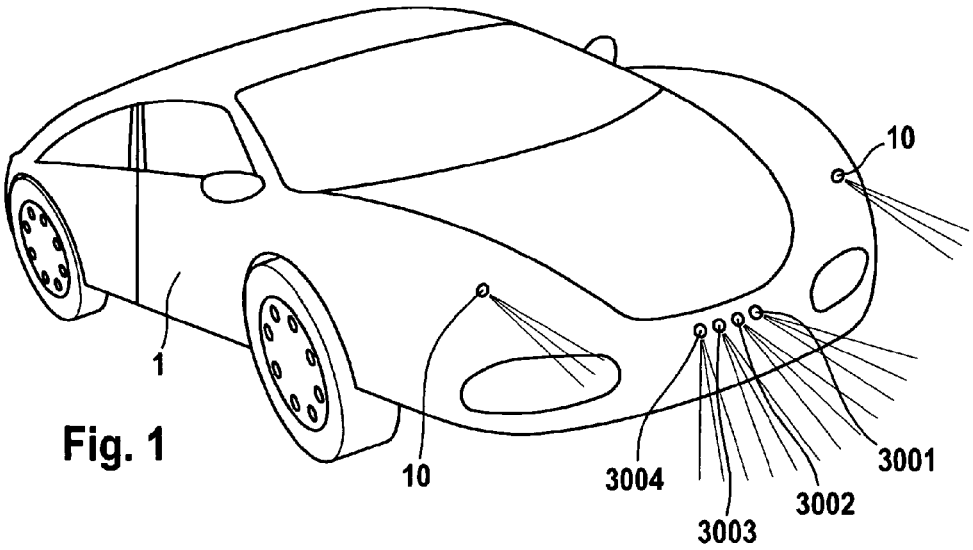
FIG. 1 shows an example of an embodiment of a motor vehicle.

FIG. 1 shows an example of embodiment of a motor vehicle 1 having motor vehicle headlights 10 and motor vehicle headlights/partial headlights 3001, 3002, 3003, and 3004, which are integrated in the body of the motor vehicle 1 within the central third of the front of the motor vehicle 1. The motor vehicle headlights 10 are, in particular, integrated in the body of the motor vehicle 1 within the marginal area of the front of the motor vehicle 1.

Figure 2:
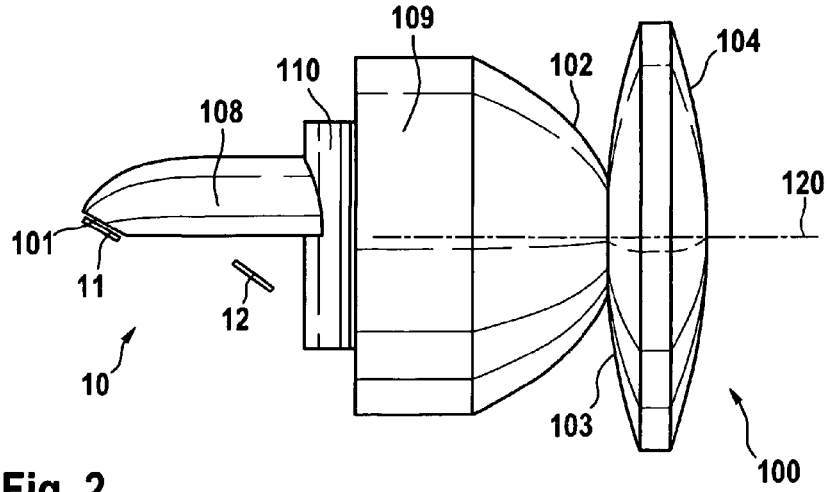
FIG. 2 shows an example of an embodiment of a headlight lens for use in the motor vehicle according to FIG. 1.
Figure 3:
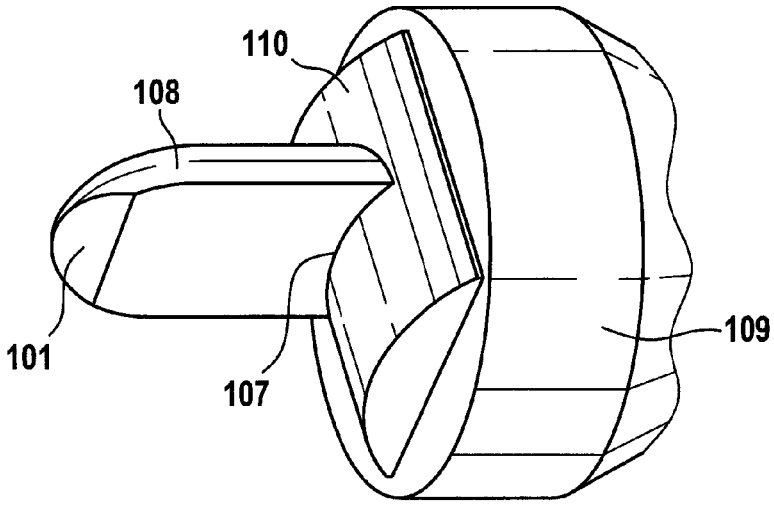
FIG. 3 shows a perspective view from below of a cut-out representation of a headlight lens of the motor vehicle headlight lens according to FIG. 2.

FIG. 2 shows the motor vehicle headlight 10 in a side view having a headlight lens 100, but without a housing, fittings and energy supply, with the headlight lens 100 being represented in FIG. 3 in a cut-out manner by way of a perspective bottom view (view from below). The headlight lens 100 comprises a blank-molded monolithic body made from inorganic glass, in particular glass, which comprises 0.2 to 2% by weight $Al_2O_3$
0.1 to 1% by weight $Li_2O$,
0.3 (in particular 0.4) to 1.5% by weight $Sb_2O_3$
60 to 75% by weight $SiO_2$,
3 to 12% by weight $Na_2O$,
3 to 12% by weight $K_2O$, and
3 to 12% by weight CaO.

The blank-molded monolithic body comprises a light tunnel 108, which, on its one side, has a light entry face 101 and, on another side, passes over into a light passage (or conductive) section 109 (of the blank-molded monolithic body) via a bend 107 curved in two spatial directions, which section 109 has a light exit face 102, a light entry face 103 as well as a further light exit face 104. The headlight lens 100 is configured such that light entering the headlight lens 100 through the light entry face 101 and, in the region of the bend 107 entering the passage section from the light tunnel 108 will exit from the light exit face 104 essentially in parallel to the optical axis 120 of the headlight lens 100. Herein, the light passage section 109 images the bend 107 as a light-dark-boundary. A portion of the surface of the light passage section 109 facing the light tunnel 108 is configured as a Petzval surface, said surface portion having been designated by reference numeral 110.

The headlight lens 10 has a light source 11 configured as an LED and a light source 12 configured as an LED. For the purpose of implementing dipped-beam headlights light is irradiated into or made to enter, respectively, the light entry face 101 of the light tunnel 108 by means of the light source 11. By means of light source 12, which may be switched-on alternatively for implementing a sign light or a high-beam headlight, light is introduced or irradiated, respectively, into a bottom side of the light tunnel 108 or into the portion 110, respectively, of the surface of the light passage section 109 facing the light tunnel 108, which portion 110 is configured as a Petzval surface.

Figure 4:
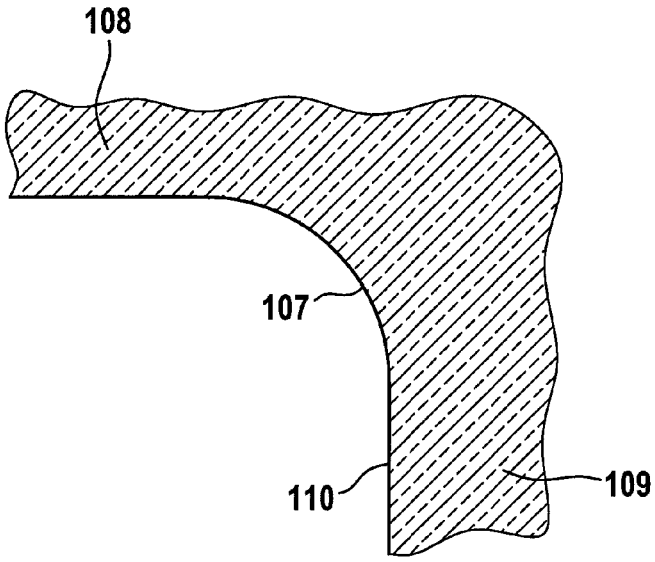
FIG. 4 shows an enlarged representation of a cut-out cross section of a bend for the transition of a light tunnel into a passage section of a headlight lens according to FIG. 3.

FIG. 4 shows, by way of an enlarged representation, a cut-out of the bend 107 for transition of the light tunnel 108 into the light passage section 109, the bend 107 being formed by blank-molding and configured as a continuous, curved transition having a radius of curvature of at least 0.15 mm.

Figure 5:
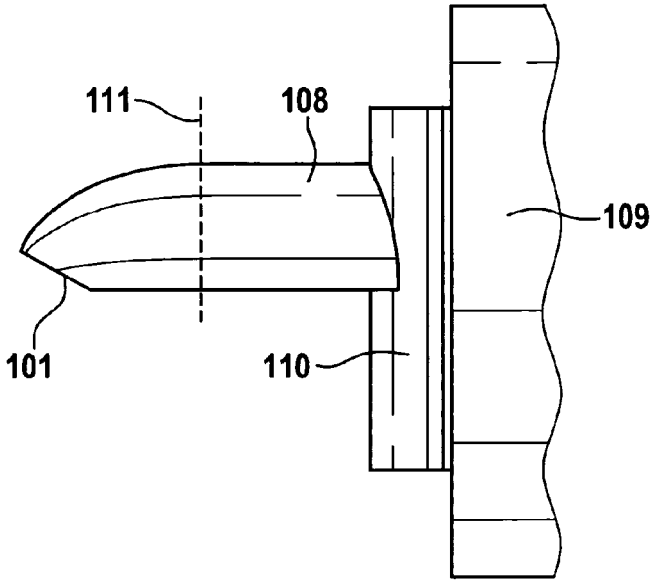
FIG. 5 shows a cut-out representation of a headlight lens according to FIG. 3 by way of a side view.
Figure 6:
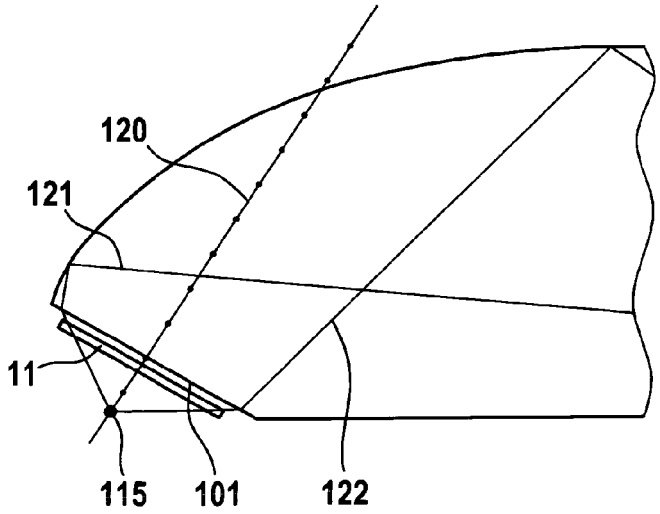
FIG. 6 shows a cut-out representation of a light tunnel of headlight lens of FIG. 3 by way of a side view.
Figure 7:
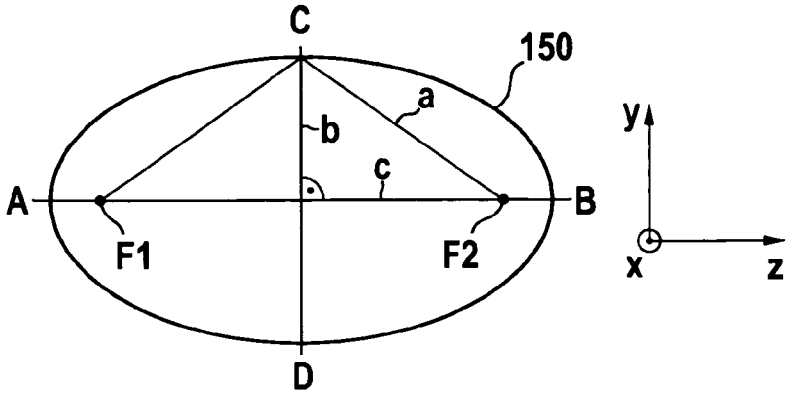
FIG. 7 shows an example of embodiment for an ellipsoid.
Figure 8:
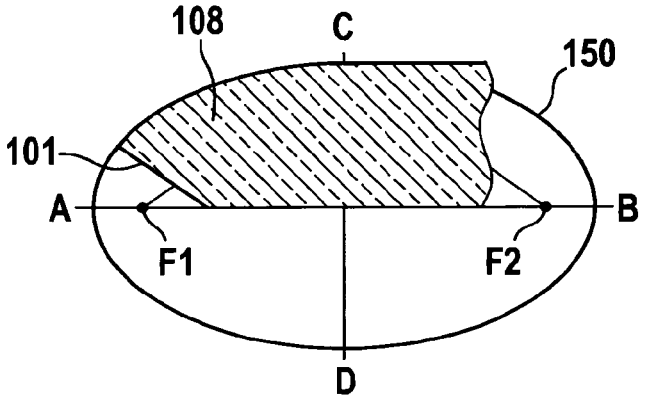
FIG. 8 shows a cross sectional representation of the ellipsoid according to FIG. 7 with a superimposed representation of a portion of the light tunnel represented in FIG. 6.

FIG. 5 shows a cut-out representation of a side view of the headlight lens 100. FIG. 6 shows an enlarged cut-out representation of a part of the light tunnel 108 up to the dotted line in FIG. 5 designated by reference numeral 111. The upper portion of the part of the light tunnel as shown in FIG. 6 has been configured as an ellipsoid 150 as represented in FIG. 7. Herein, the dotted line 111 approximately corresponds to the axis C-D. For clarifying this embodiment, a part of the cross section of the light tunnel 108 in FIG. 8 is shown in a manner superimposing (overlaying) the representation of the ellipsoid 150. With regard to the ellipsoid 150 represented in FIG. 7 the following applies:

$$\frac{x^2}{a^2} + \frac{y^2}{b^2} + \frac{z^2}{c^2} - 1 = 0$$

In this formula z is a coordinate in the direction of the optical axis of the light tunnel (A→B);

x is a coordinate orthogonal to the direction of the optical axis of the light tunnel; and y is a coordinate orthogonal to the direction of the optical axis of the light tunnel and to the x-direction (D→C).

a, b and, consequently, c have been chosen such that all light beams or rays which pass through focus F1 will concentrate again in focus F2 after mirroring in the surface of the ellipsoid. The course of the beams of light from the light source 11, which is irradiated into or made to enter, respectively, the light entry face 101 is illustrated by the light beams 121 and 122 depicted in FIG. 6. Reference numeral 120 of FIG. 6 designates the orthogonal of the light entry face 101. The mutual point of intersection of the orthogonal 120 of the light entry face 101 with the light beams 121 and 122 has been designated by reference numeral 115. The position of this point of intersection 115 corresponds to focus F1 in FIG. 7 and FIG. 8.

Figure 9:
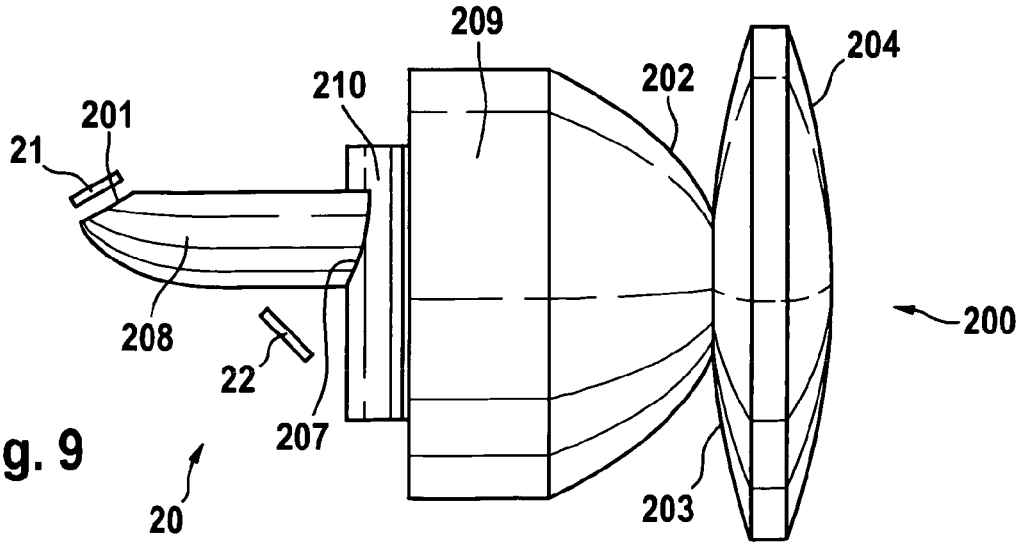
FIG. 9 shows a side view of an alternative example of embodiment of a motor vehicle headlight (for use in the motor vehicle according to FIG. 1)

FIG. 9 shows, by way of a side elevation, a motor vehicle headlight 20 to be used alternatively instead of motor vehicle headlight 10. The motor vehicle headlight 20 comprises a headlight lens 200. The headlight lens 200 comprises a blank-molded monolithic body made from inorganic glass and comprising a light tunnel 208, which has a light entry face 201 on one side and, on the other side, forms transition into a light passage or conductive section 209 (of the blank-molded monolithic body) via a bend 207 curved in three spatial dimensions, which light conductive section 209 includes a light exit face 202, a light entry face 203, as well as a further light exit face 204. The headlight lens 200 is shaped such that light, which enters the headlight lens 200 through the light entry face 201, and from the light tunnel 208 enters the passage section in the region of the bend 207, will exit from the light exit face 204 essentially parallel to the optical axis of the headlight lens 200. Herein, the light passage section 209 images the bend 207 as a light-dark-boundary. A portion of the surface of the light passage section 209 designated by reference numeral 210 and facing the light tunnel 208 is shaped as a Petzval surface.

The vehicle headlight 20 includes a light source 21 configured as an LED, and a light source 22 configured as an LED. By means of light source 21, and for the purpose of implementing dipped-beam headlight, light is irradiated into or made to enter, respectively, the light entry face 201 of the light tunnel 208. By means of the selectively connectable light source 22, and for implementing sign light or high-beam headlight, light is made to enter or is irradiated into, respectively, a bottom side of the light tunnel 208 or the Petzval-face-configured portion 210 of the surface of the light passage section 209 facing the light tunnel 208.

FIG. 10 shows a further motor vehicle headlight 30 by way of a side elevation and to be used alternatively with regard to motor vehicle headlight 10. The motor vehicle headlight 30 comprises a headlight lens 300. FIG. 11 shows the headlight lens 300 by way of a top view, and FIG. 12 shows the headlight lens 300 from the rear. The headlight lens 300 comprises a blank-molded monolithic body made from inorganic glass, which body comprises a light tunnel 308, which has a light exit face 301 on one side and, on the other side, passes over into a light passage or conductive section 309 (of the blank-molded monolithic body) via a bend 307 curved in two spatial dimensions, which light passage section 309 includes a light exit face 302. The headlight lens 300 is configured such that light which enters the headlight lens 300 through the light entry face 301 and, from the light tunnel 308 enters the passage section in the region of the bend 307 will exit from the light exit face 302 essentially in parallel to the optical axis of the headlight lens 300. Herein, the light passage section 309 images the bend 307 as a light-dark-boundary, just as it has been depicted in FIG. 13. A portion of the surface of the light passage section 309 designated by reference numeral 310 and facing the light tunnel 308 is shaped as a Petzval face. A rim or edge, in particular a circumferential edge, may be provided on the section (designated by reference numeral 330) of the surface of the passage section 309, by means of which edge the headlight lens 300 may be fixed in a particularly appropriate manner.

The vehicle headlight 30 includes a light source 31 configured as an LED, and a light source 32 configured as an LED. By means of the light source 31, and for the purpose of implementing dipped-beam headlight, light is irradiated into or made to enter, respectively, the light entry face 301 of the light tunnel 308. By means of the selectively connectable light source 32 for implementing sign light or high-beam headlight, light is made to enter or is irradiated, respectively, into a bottom side of the light tunnel 308 or into the Petzval surface-configured portion 310 of the surface of the light passage section 309 facing the light tunnel 308.

Figure 14:
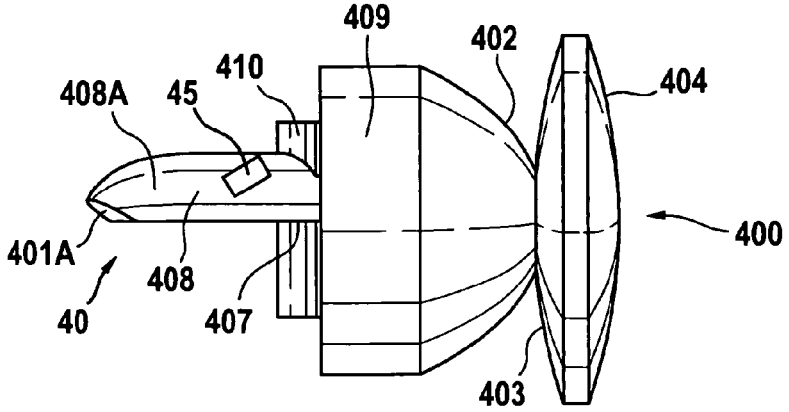
FIG. 14 shows a side view of a further alternative example of embodiment of a motor vehicle headlight (for use in the motor vehicle according to FIG. 1)
Figure 15:
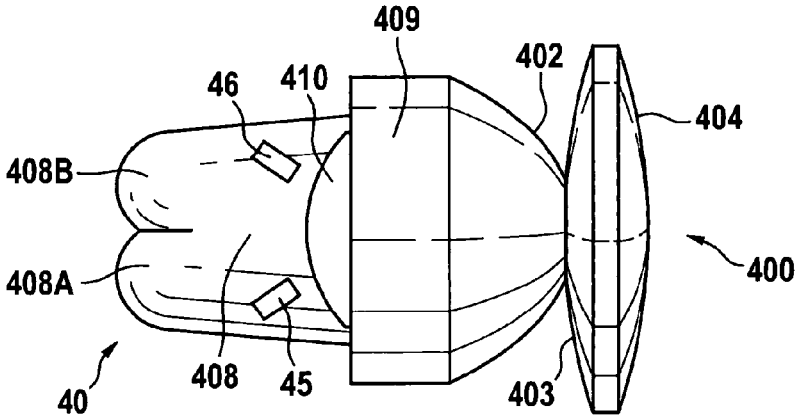
FIG. 15 shows the motor vehicle headlight according to FIG. 14 by way of a top view.
Figure 16:
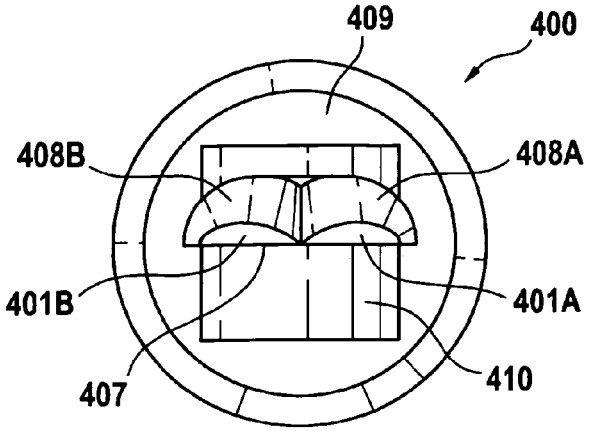
FIG. 16 shows a view from the rear of an example of embodiment of the headlight lens of the motor vehicle headlight according to FIG. 14.

FIG. 14 shows a further motor vehicle headlight 40 by way of a side elevation and to be used alternatively with regard to motor vehicle headlight 10. The motor vehicle headlight 40 comprises a headlight lens 400. FIG. 15 shows the motor vehicle headlight 40 by way of a top view, and FIG. 16 shows the headlight lens 400 from the rear. The headlight lens 400 comprises a blank-molded monolithic body made from inorganic glass, which body includes a light tunnel section 408A and a light tunnel section 408B, which open out in a light tunnel 408 which, in turn, passes over to a light passage section 409 (of the blank-molded monolithic body) via a bend 407 curved in two spatial directions, which section 409 includes a light exit face 402, a light entry face 403, as well as a further light exit face 404. The light tunnel section 408A has a light entry face 401A, and the light tunnel section 408B has a light entry face 401B. The headlight lens 400 is shaped such that light, which enters the headlight lens 400 through the light entry faces 401A and 401B and, in the region of the bend 407 enters the passage section from the light tunnel 408 will exit from the light exit face 404 essentially parallel to the optical axis of the headlight lens 400. Herein, the light passage section 409 images the bend 407 as a light-dark-boundary. A portion of the surface of the light passage section 409 designated by reference numeral 410 and facing the light tunnel 408 is shaped as a Petzval surface.

Figure 17:
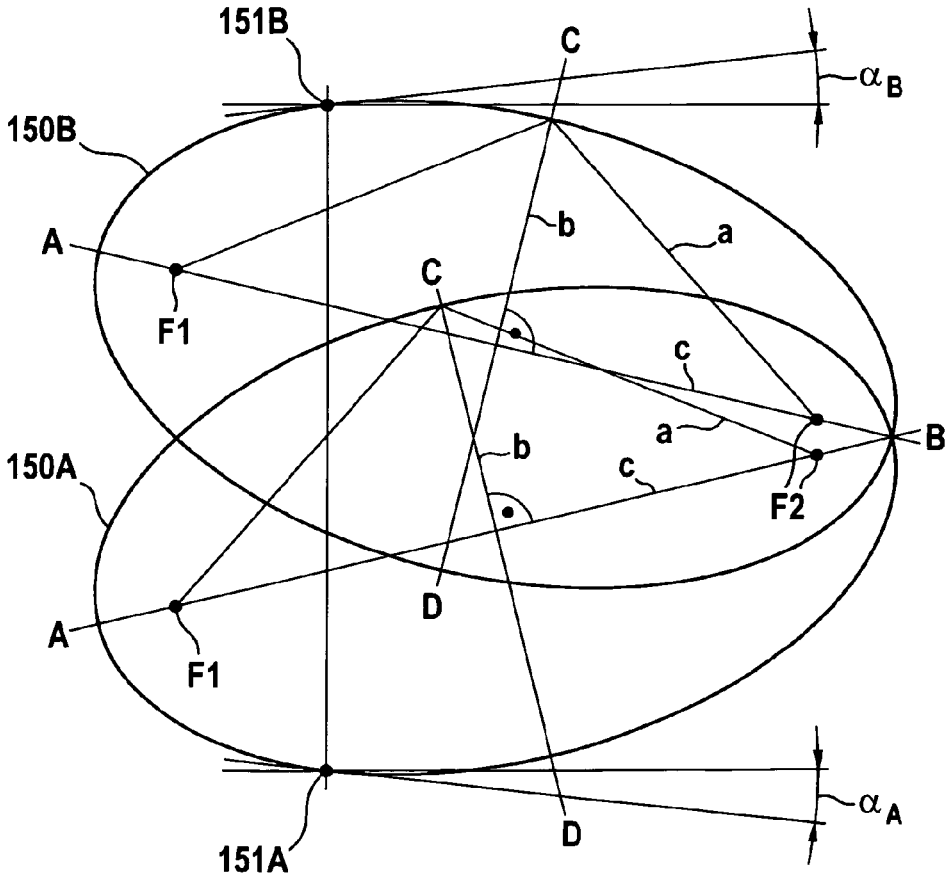
FIG. 17 shows a principle representation of an example of embodiment for the superimposition of two ellipsoids.

At least in their upper region, the light tunnel sections 408A and 408B are configured—taken in analogy to the explanations relating to FIG. 6—as part of an ellipsoid, as has been represented in principle in FIG. 17. Herein, reference numeral 150A designates an ellipsoid associated with the light tunnel section 408A, and reference numeral 150B designates an ellipsoid associated with the light tunnel section 408B. The ellipsoids 150A and 150B are, as has been represented in FIG. 17, aligned in relation to each other such that the respective focuses F2 will lie on top of each other. At the points designated by reference numerals 151A and 151B or starting at points 151A and 150B, respectively (in the direction of light propagation or towards the right, respectively), the surface contour of the headlight lens 400 deviates from the contour of an ellipsoid. Herein, the angles $\alpha_A$ and $\alpha_B$ indicate the directions of deviation from the elliptic shape.

The motor vehicle headlight 40 includes two light sources, which, in analogy to light source 11 have been configured as LEDs and have not been depicted in FIG. 14 and FIG. 16 for the sake of clarity. By means of one of the light sources, and for the purpose of implementing dipped-beam headlight, light is irradiated into or made to enter, respectively, the light entry face 401A of the light tunnel section 408A, and by means of the other one of the light sources, and for the purpose of implementing dipped-beam headlight, light is irradiated into or made to enter, respectively, the light entry face 401B of the light tunnel section 408B. In addition, a non-shown the light source may be provided which corresponds to light source 12 with respect to position and performance.

In addition, and for implementing a corner light and/or a front fog light (adverse weather lamp) light sources 45 and 46 configured as LEDs are provided, with the light sources 45 and 46 being alternatively connectable for implementing the corner light. Herein, a non-shown control is provided for within the motor vehicle 4, by means of which the control light source 45 is switched on for the time of driving round a left corner, and light source 46 is switched on for the time of driving round a right corner. For implementing a front fog light, either light source 46 or both light sources 45 and 46 are switched on.

Figure 18:
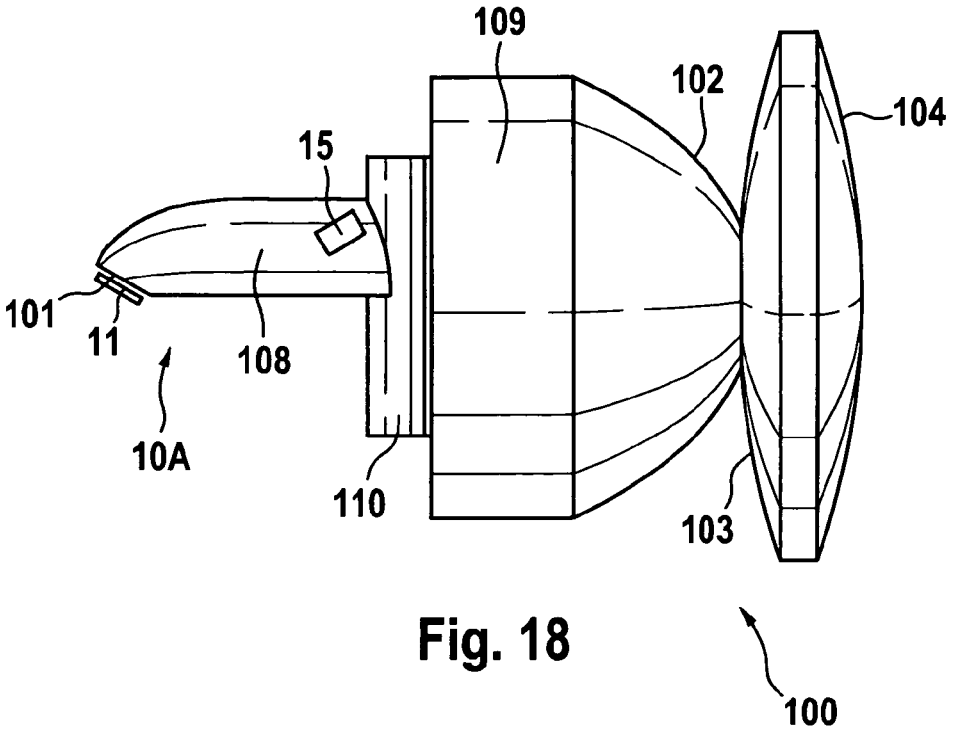
FIG. 18 shows a side view of a further example of embodiment of a motor vehicle headlight for use in the motor vehicle according to FIG. 1.
Figure 19:
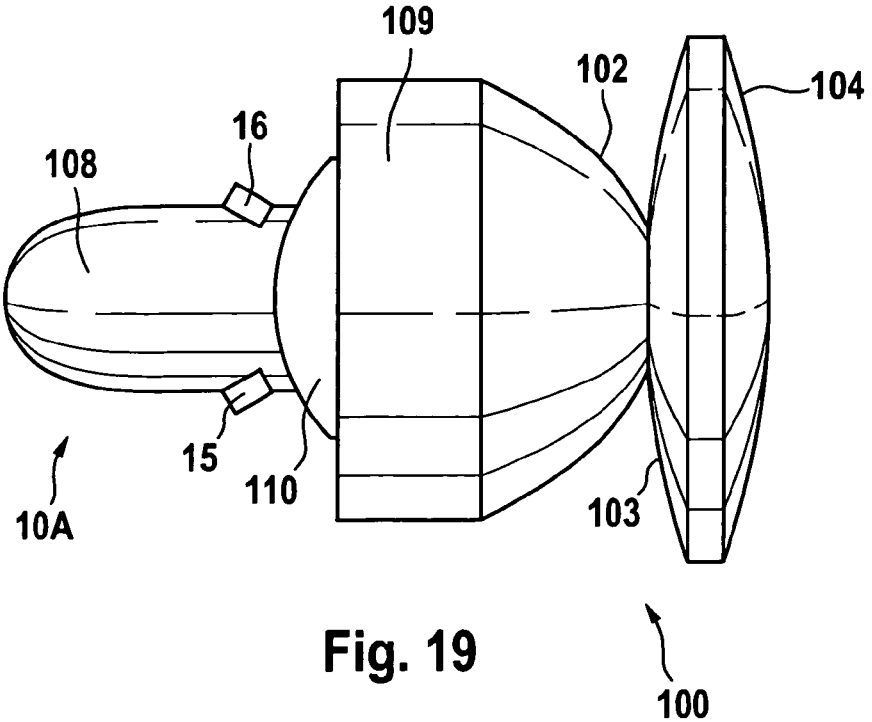
FIG. 19 shows the motor vehicle headlight according to FIG. 18 by way of a top view.

FIG. 18 and FIG. 19 show a motor vehicle headlight lens 10A to be used alternatively with regard to motor vehicle headlight 10. Herein, FIG. 18 shows the motor vehicle headlight lens 10A in a side elevation and FIG. 19 shows the motor vehicle headlight lens 10A in a top view. The motor vehicle headlight lens 10 A comprises the headlight lens 100 as well as the light source 11. In addition, for implementing a corner (or curve) light and/or a front fog light, light sources 15 and 16 configured as LEDs have been provided. It may as well be provided for that, in addition, the light source 12 is implemented within the motor vehicle headlight 10A.

For implementing a corner light the light sources 15 and 16 may be switched on alternatively. In this context, a non-shown control is provided for in the motor vehicle 1, by means of which light source 15 may be switched on for the time of driving round a left corner and light source 16 may be switched on for the time of driving round a right corner. For implementing a front fog light either the light source 16, only, or both light sources 15 and 16 are switched on.

Figure 20:
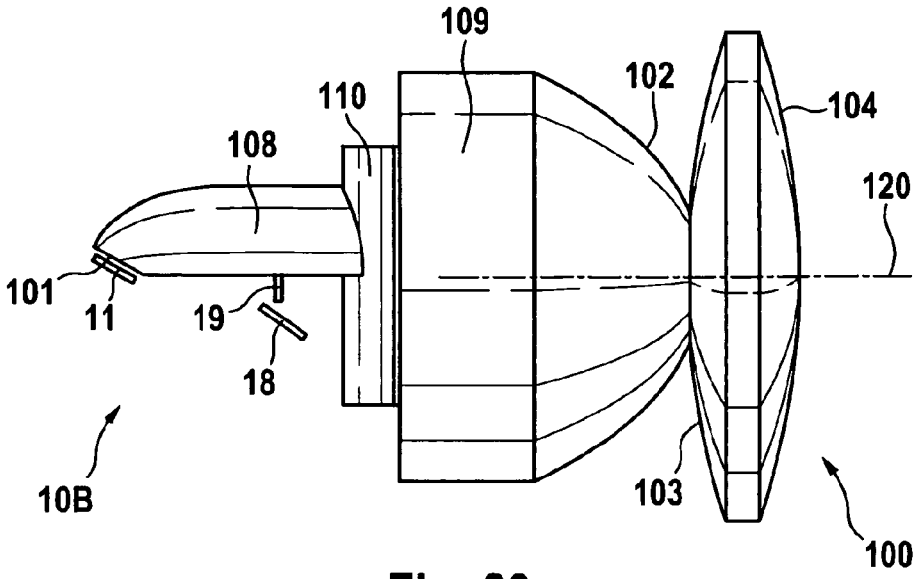
FIG. 20 shows a side view of a further example of an embodiment of a motor vehicle headlight for use in the motor vehicle according to FIG. 1.

FIG. 20 shows a motor vehicle headlight 10B (based on headlight lens 100) to be used alternatively with regard to motor vehicle headlight 10 and including a light source 18 for a high-beam headlight function configured as an LED and adapted to be connected, and a light source 19 configured as an LED for a sign light function, wherein the light output of the light source 18 is higher than that of light source 19.

Figure 21:
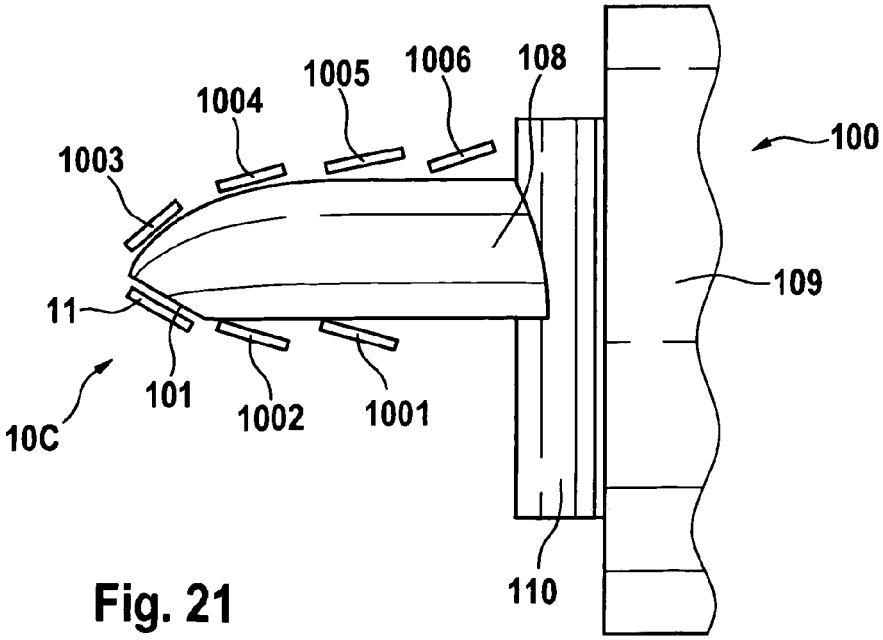
FIG. 21 shows a cut-out side-elevation of a further example of embodiment of a motor vehicle headlight for use in the motor vehicle according to FIG. 1.

FIG. 21 shows a further motor vehicle headlight 100 based on headlight lens 100 alternatively to be used instead of motor vehicle headlight 10. Herein, additional light sources 1001, 1002, 1003, 1004, 1005, 1006 are provided along the light tunnel 108. By means of this arrangement a higher light output may be achieved. The light sources 1003, 1004, 1005, 1006 or one or several of the light sources 1003, 1004, 1005, 1006 may be provided in context with the motor vehicle headlight 10B as well.

FIG. 22 shows a further motor vehicle headlight 10D based on headlight lens 100 and alternatively to be used instead of motor vehicle headlight 10. FIG. 23 shows the motor vehicle headlight 10D from the rear, however without the light source 11. Herein, by means of an LED array 1010 light is made to enter the Petzval-face-configured surface 110 of the passage section 109, the components of which array being adapted to be individually controlled or connected, respectively.

Figure 24:
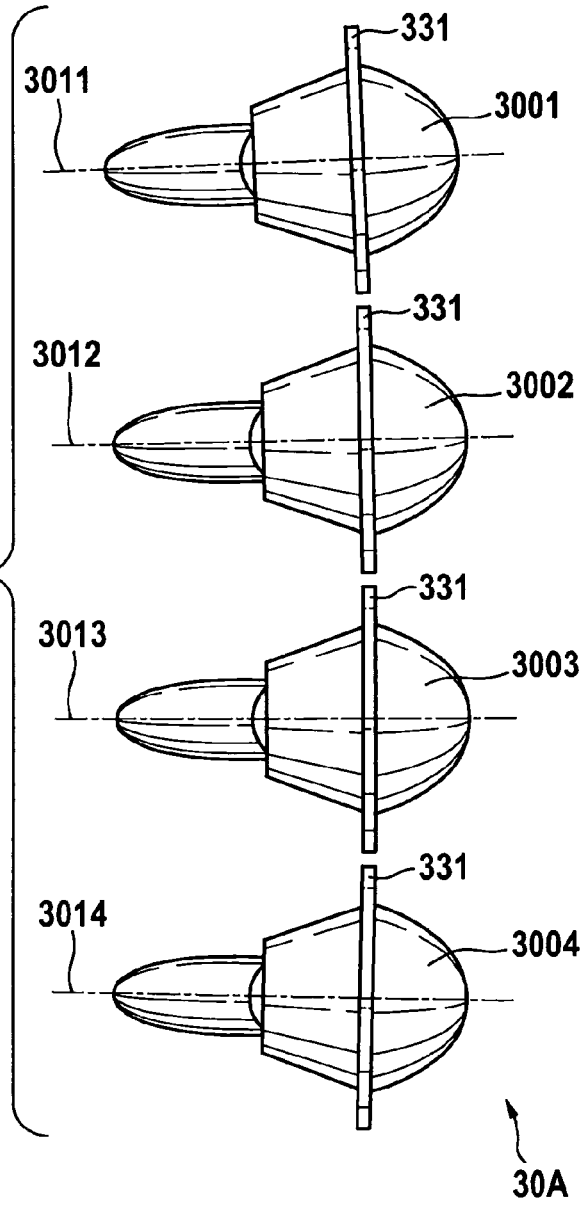
FIG. 24 shows a top view of a further example of embodiment of a motor vehicle headlight for use in the motor vehicle according to FIG. 1.

FIG. 24 shows an example of embodiment of an alternatively applicable motor vehicle headlight arrangement 30A in a top view. The motor vehicle headlight arrangement 30A has the partial headlights 3001, 3002, 3003, and 3004, which have headlight lenses configured in analogy to headlight lens 300, each, however, having a circumferential rim or edge 331 with differently configured bends, so that the light-dark-boundary 3005 represented in FIG. 25 will be generated. It may be provided for that the partial headlights 3001, 3002, 3003, and 3004 have LED arrays corresponding to LED array 1010.

It may be provided for that instead of the partial headlight 3001 the motor vehicle headlight 10, the motor vehicle headlight 10A, the motor vehicle headlight 10B, the motor vehicle headlight 10C, the motor vehicle headlight 10D, the motor vehicle headlight 20 or the motor vehicle headlight 40 will be used, the associated bend corresponding to the bend of the partial headlight 3001. It may be provided for that instead of the partial headlight 3002 the motor vehicle headlight 10, the motor vehicle headlight 10A, the motor vehicle headlight 10B, the motor vehicle headlight 100, the motor vehicle headlight 10D, the motor vehicle headlight 20 or the motor vehicle headlight 40 will be used, the associated bend corresponding to the bend of partial headlight 3002. It may be provided for that instead of the partial headlight 3003 the motor vehicle headlight 10, the motor vehicle headlight 10A, the motor vehicle headlight 10B, the motor vehicle headlight 100, the motor vehicle headlight 10D, the motor vehicle headlight 20, or the motor vehicle headlight 40 be used, the associated bend corresponding to the bend of partial headlight 3003. It may be provided for that instead of the partial headlight 3004 the motor vehicle headlight 10, the motor vehicle headlight 10A, the motor vehicle headlight 10B, the motor vehicle headlight 100, the motor vehicle headlight 10D, the motor vehicle headlight 20 or the motor vehicle headlight 40 will be used, the associated bend corresponding to the bend of partial headlight 3004.

Figure 25:
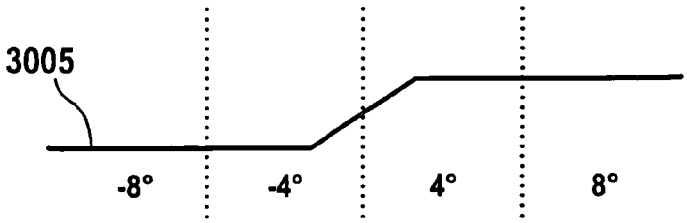
FIG. 25 shows a bright-dark-boundary generated by means of the motor vehicle headlight according to FIG. 24.

The optical axes 3011, 3012, 3013, and 3014 of the partial headlights 3001, 3002, 3003, and 3004, respectively, lie in a horizontal plane and are slightly inclined therein with respect to each other so that partial headlight 3001 illuminates essentially the −8° region, the partial headlight 3002 illuminates essentially the −4° region, the partial headlight 3003 illuminates essentially the 4° region and the partial headlight 3004 illuminates essentially the 8° region, respectively, (cf. FIG. 25). It may be provided for that the partial headlights 3001, 3002, 3003, and 3004 be fixedly connected with each other within a module. It may be provided for that the partial headlights 3001, 3002, 3003, and 3004 are arranged in a mutual housing. It may also be provided for that the partial headlights 3001, 3002, 3003, and 3004 as well as further corresponding partial headlights are arranged along the circumference of a geometrical figure, in particular along a circle.

Figure 26:
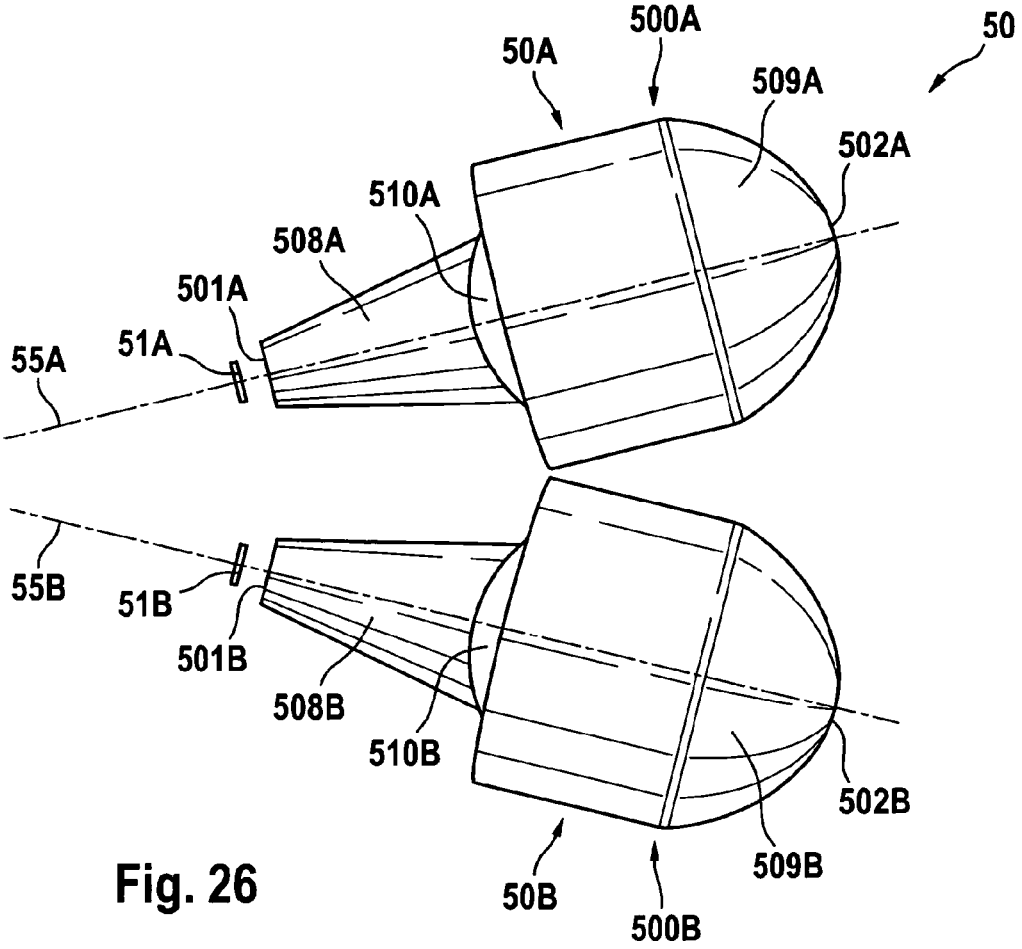
FIG. 26 shows a top view of an example of embodiment of a motor vehicle headlight lens array for use in the motor vehicle according to FIG. 1.
Figure 27:
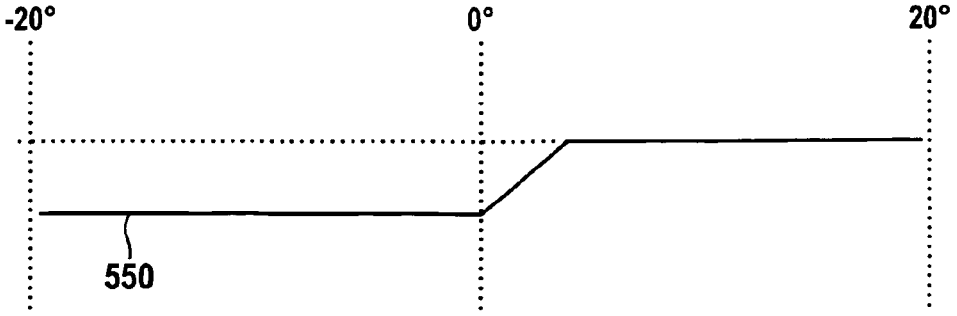
FIG. 27 shows a bright-dark-boundary generated by means of the motor vehicle headlight according to FIG. 24.

FIG. 26 shows a further example of embodiment of a motor vehicle 1A having motor vehicle headlights 10A and motor vehicle headlights/partial headlights 3001, 3002, 3003, and 3004, which are integrated in the body of the motor vehicle 1A within the central third of the front of the motor vehicle 1. The motor vehicle headlights 10A are integrated in the body of the motor vehicle 1A within the marginal area of the front of the motor vehicle 1A. It may also be provided for that the motor vehicle headlights 10A are integrated in the bumper 2 within the marginal area of the front of the motor vehicle 1A.

FIG. 26 shows a motor vehicle headlight arrangement 50 by way of a top view and to be used alternatively with regard to motor vehicle headlight 10. The motor vehicle headlight arrangement 50 includes partial headlights designated by reference numerals 50A and 50B. The partial headlight 50A comprises a headlight lens 500A. The headlight lens 500A comprises a blank-molded monolithic body of inorganic glass and including a light tunnel 508A, which has a light entry face 501A on one side and, on another side (on the bottom side of the headlight lens 500A), passes over into a light passage or conductive section 509A (of the blank-molded monolithic body) via a bend curved in two spatial dimensions, which light conductive section includes a light exit face 502A. The headlight lens 500A is shaped such that light, which enters the headlight lens 500A through the light entry face 501A, and from the light tunnel 508A enters the passage section in the region of the bend, will exit from the light exit face 502A essentially in parallel to the optical axis 55A of the headlight lens 500A. Herein, the light passage section 509A images the bend as a light-dark-boundary 550, as has been represented in FIG. 37. Herein the partial headlight 50A illuminates essentially the region between −20° and 0°. A portion of the surface of the light passage section 509A, which portion is facing the light tunnel 508A and has been designated by reference numeral 510A, is configured as a Petzval surface. The partial headlight 50A includes a light source 51A configured as an LED. For implementing a dipped-beam headlight, light is irradiated into or made to enter, respectively, the light entry face 501A of the light tunnel 508A by means of the light source 51A.

The partial headlight 50B comprises a headlight lens 500B. The headlight lens 500B comprises a blank-molded monolithic body made from inorganic glass and including a light tunnel 508B, which has a light entry face 501B on one side and, on another side (on the bottom side of the headlight lens 500B), passes over into a light conductive section 509B (of the blank-molded monolithic body) via a bend curved in two spatial dimensions, which light conductive section includes a light exit face 502B. The headlight lens 500B is shaped such that light, which enters the headlight lens 500B through the light entry face 501B, and from the light tunnel 508B enters the passage section in the region of the bend, will exit from the light exit face 502B essentially parallel to the optical axis 55B of the headlight lens 500B. Herein, the light passage section 509B images the bend as a light-dark-boundary 550, as has been represented in FIG. 37. Herein the partial headlight 50B illuminates essentially the region between 0° and 20°. A portion of the surface of the light passage section 509B, which portion is facing the light tunnel 508B and has been designated by reference numeral 510B, is configured as a Petzval surface. The partial headlight 50B includes a light source 51B configured as an LED. For implementing dipped-beam headlight, light is irradiated into or made to enter, respectively, the light entry face 501B of the light tunnel 508B by means of the light source 51B. The optical axes 55A and 55B are the lie in one horizontal plane and, in this plane, are inclined by 25° with regard to each other.

Figure 28:
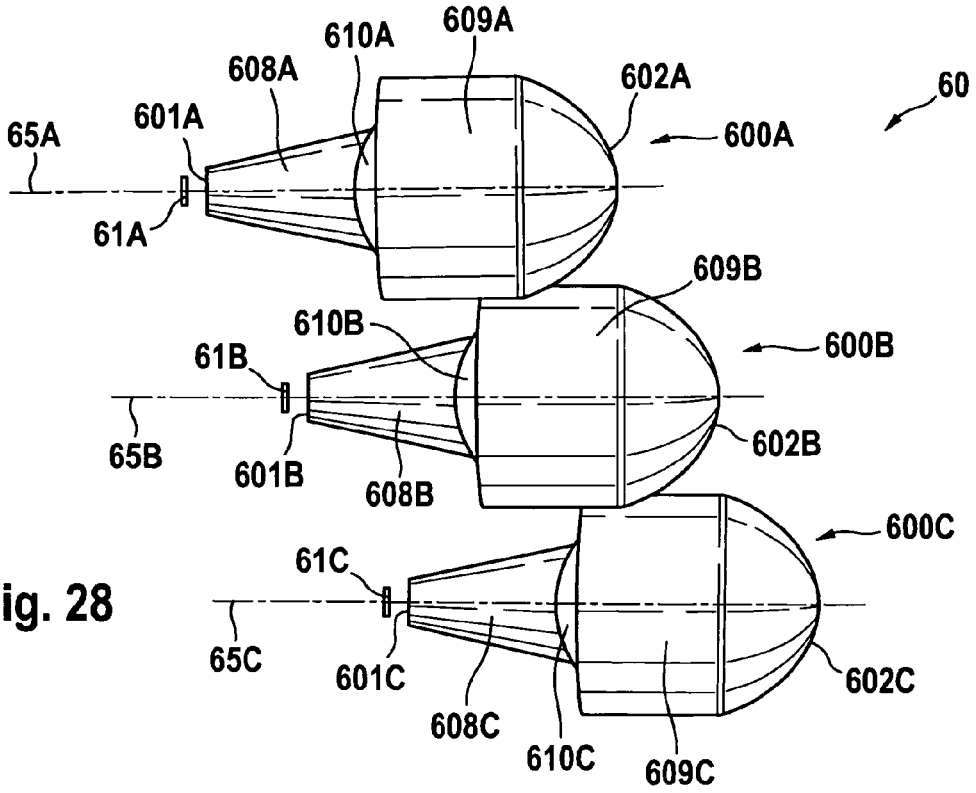
FIG. 28 shows a top view of a further example of embodiment of a motor vehicle headlight for use in the motor vehicle according to FIG. 1.

FIG. 28 shows, by way of a top view, a further motor vehicle headlight 60 alternatively to be used instead of motor vehicle headlight 10. The motor vehicle headlight 60 comprises a blank-molded monolithic body of inorganic glass and comprising a headlight lens part 600A, a headlight lens part 600B, and a headlight lens part 600C.

The headlight lens part 600A comprises a light tunnel 608A, which has a light entry face 601A on one side and, on another side (on the bottom side of the headlight lens part 600A), passes over into a light passage or conductive section 609A of the headlight lens part 600A via a bend curved in two spatial dimensions, which light conductive section 609A includes a light exit face 602A. The headlight lens part 600A is shaped such that light, which enters the headlight lens 600A through the light entry face 601A, and from the light tunnel 608A enters the passage section in the region of the bend, will exit from the light exit face 602A essentially in parallel to the optical axis 65A of the headlight lens part 600A. Herein, the light passage section 609A images the bend as a light-dark-boundary. A portion of the surface of the light passage section 609A, which portion is facing the light tunnel 608A and has been designated by reference numeral 610A, is configured as a Petzval face. The motor vehicle headlight 60 includes a light source 61A configured as an LED, by means of which, for implementing dipped-beam headlight, light is irradiated into or made to enter, respectively, the light entry face 601A of the light tunnel 608A.

The headlight lens part 600B comprises a light tunnel 608B, which has a light entry face 601B on one side and, on another side (on the bottom side of the headlight lens part 600B), passes over into a light passage or conductive section 609B of the headlight lens part 600B via a bend curved in two spatial dimensions, which light conductive section 609B includes a light exit face 602B. The headlight lens part 600B is shaped such that light, which enters the headlight lens 600B through the light entry face 601B, and, in the region of the bend, from the light tunnel 608B enters the passage section will exit from the light exit face 602B essentially in parallel to the optical axis 65B of the headlight lens part 600B. Herein, the light passage section 609B images the bend as a light-dark-boundary. A portion of the surface of the light passage section 609B, which portion is facing the light tunnel 608B and has been designated by reference numeral 610A, is configured as a Petzval surface. The motor vehicle headlight 60 includes a light source 61B configured as an LED, by means of which, for implementing dipped-beam headlight, light is irradiated into or made to enter, respectively, the light entry face 601B of the light tunnel 608B.

The headlight lens part 600C comprises a light tunnel 608C, which has a light entry face 601C on one side and, on another side (on the bottom side of the headlight lens part 600C), transits into a light passage section 609C of the headlight lens part 600C via a bend curved in two spatial dimensions, which light passage section 609C includes a light exit face 602C. The headlight lens part 600C is shaped such that light, which enters the headlight lens 600C through the light entry face 601C, and, in the region of the bend, from the light tunnel 608C enters the passage section will exit from the light exit face 602C essentially in parallel to the optical axis 65C of the headlight lens part 600C. Herein, the light passage section 609C maps the bend as a light-dark-boundary. A portion of the surface of the light passage section 609C, which portion is facing the light tunnel 608C and has been designated by reference numeral 610C, is configured as a Petzval surface. The motor vehicle headlight 60 includes a light source 61C configured as an LED, by means of which, for implementing dipped-beam headlight, light is irradiated into or made to enter, respectively, the light entry face 601C of the light tunnel 608C.

The optical axis 65A lies in a first plane which is essentially horizontal. The optical axis 65B lies in a second essentially horizontal plane. The optical axis 65C lies in a third essentially horizontal plane. The first plane, the second plane, and the third plane extend essentially in parallel to each other. The optical axis 65A, moreover, lies in a first vertical plane. The optical axis 65B, moreover, lies in a second vertical plane. The optical axis 65C, moreover, lies in a third vertical plane. The first vertical plane is inclined by 0.5° with respect to the second vertical plane. The first vertical plane is inclined by 1° with respect to the third vertical plane. The second vertical plane is inclined by 0.5° with respect to the third vertical plane.

Figure 29:
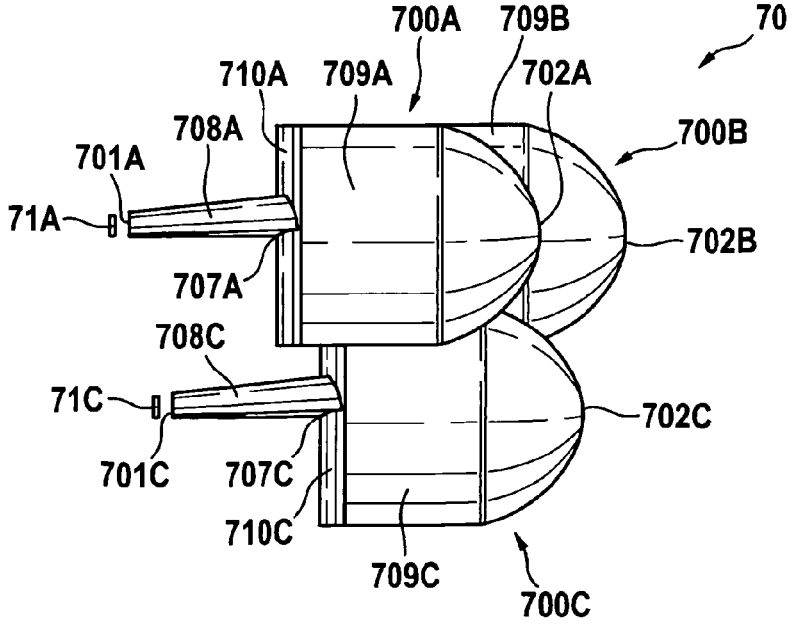
FIG. 29 shows a top view of a further example of embodiment of a motor vehicle headlight for use in the motor vehicle according to FIG. 1.

FIG. 29 shows, by way of a top view, a further motor vehicle headlight 70 alternatively to be used instead of the motor vehicle headlight 10. The motor vehicle headlight 70 comprises a blank-molded monolithic body made of inorganic glass and comprising a headlight lens part 700A, a headlight lens part 700B, and a headlight lens part 700C.

The headlight lens part 700A comprises a light tunnel 708A, which has a light entry face 701A on one side and, on another side, forms a transition into a light passage section 709A of the headlight lens part 700A via a bend 707A curved in two spatial dimensions, which light passage section 709A includes a light exit face 702A. The headlight lens part 700A is shaped such that light which enters the headlight lens 700A through the light entry face 701A, and from the light tunnel 708A enters the passage section in the region of the bend 707A, will exit from the light exit face 702A essentially in parallel to the optical axis of the headlight lens part 700A. Herein, the light passage section 709A will image the bend 707A as a light-dark-boundary. A portion of the surface of the light passage section 709A, which portion is facing the light tunnel 708A and has been designated by reference numeral 710A, is configured as a Petzval surface. The motor vehicle headlight 70 includes a light source 71A configured as an LED, by means of which, for the implementing of dipped-beam headlight, light is irradiated into or made to enter, respectively, the light entry face 701A of the light tunnel 708A.

The headlight lens part 700B comprises a light tunnel (in FIG. 29 concealed by headlight lens part 700A), which has a light entry face (in FIG. 29 concealed by headlight lens part 700A) on one side and, on another side (on the bottom side of the headlight lens part 700B), forms a transition with a light passage section 709B of the headlight lens part 700B via a bend curved (in FIG. 29 concealed by headlight lens part 700A) in two spatial dimensions, which light passage section 709B includes a light exit face 702B. The headlight lens part 700B is shaped such that light, which enters the headlight lens 700B through the light entry face, and, in the region of the bend, enters the passage section from the light tunnel, will exit from the light exit face 702B essentially in parallel to the optical axis of the headlight lens part 700B. In this context, the light passage section 709B images the bend as a light-dark-boundary. A portion (in FIG. 29 concealed by headlight lens part 700A) of the surface of the light passage section 709B, which portion is facing the light tunnel is configured as a Petzval surface. The motor vehicle headlight 70 includes a light source (in FIG. 29 concealed by headlight lens part 700A) configured as an LED, by means of which, for implementing dipped-beam headlight, light is irradiated into or made to enter, respectively, the light entry face of the light tunnel.

The headlight lens part 700C comprises a light tunnel 708C, which has a light entry face 701C on one side and, on another side (on the bottom side of the headlight lens part 700C), forms a transition into a light passage section 709C of the headlight lens part 700C via a bend 707C curved in two spatial dimensions, which light conductive section 709C includes a light exit face 702C. The headlight lens part 700C is configured such that light, which enters the headlight lens 700C through the light entry face 701C, and, in the region of the bend 707C, from the light tunnel 708C enters the passage section will exit from the light exit face 702C essentially in parallel to the optical axis of the headlight lens part 700C. Herein, the light passage section 709C will image the bend 707C as a light-dark-boundary. A portion of the surface of the light passage section 709C, which portion is facing the light tunnel 708C and has been designated by reference numeral 710C, is configured as a Petzval surface. The motor vehicle headlight 70 includes a light source 71C configured as an LED, by means of which, for implementing dipped-beam headlight, light is irradiated into or made to enter (coupled to), respectively, the light entry face 701C of the light tunnel 708C.

The elements, distances and angles in the figures have been drawn in consideration of simplicity and clearness and not necessarily to scale. For example, the orders of magnitude of some elements, distances and angles have been exaggerated with respect to other elements, distances and angles in order to improve comprehension of the example of embodiment of the present invention.

The invention claimed is:

1. Vehicle headlight including:

a first light source;

at least a second light source;

a first headlight lens comprising a first monolithic body of transparent material, the first monolithic body including:

a first light passage section including a first optically operative light exit face; and a first light tunnel comprising a first light entry face, wherein the first light tunnel passes over, via a first bend, into the first light passage section for imaging the first bend as a light-dark-boundary by means of light irradiated from the first light source into the first light entry face of the first headlight lens; and at least a second headlight lens comprising a second monolithic body of transparent material, the second monolithic body including:

a second light passage section including a second optically operative light exit face;

a second light tunnel comprising a second light entry face, wherein the second light tunnel passes over, via a second bend, into the second light passage section for imaging the second bend as a light-dark-boundary by means of light irradiated from the second light source into the second light entry face of the second headlight lens, wherein the second headlight lens comprises an optical axis which is inclined with respect to an optical axis of the first headlight lens by at least 0.5°; and further comprising: an additional light source for irradiating light directly into the first light passage section.

2. The vehicle headlight of claim 1, further comprising:

at least a third light source; and at least a third headlight lens comprising a third monolithic body of transparent material, the third monolithic body including:

a third light passage section including a third optically operative light exit face; and a third light tunnel comprising a third light entry face, wherein the third light tunnel passes over, via a third bend, into the third light passage section for imaging the third bend as a light-dark-boundary by means of light irradiated from the third light source into the third light entry face of the third headlight lens, wherein the third headlight lens comprises an optical axis which is inclined with respect to said optical axis of the first headlight lens by at least 0.5°.

3. The vehicle headlight of claim 2, wherein said optical axis of the third headlight lens is inclined with respect to said optical axis of the second headlight lens by at least 0.5°.

4. The vehicle headlight of claim 3, further comprising:

at least a forth light source; and at least a forth headlight lens comprising a forth monolithic body of transparent material, the forth monolithic body including:

a forth light passage section including a forth optically operative light exit face; and a forth light tunnel comprising a forth light entry face, wherein the forth light tunnel passes over, via a forth bend, into the forth light passage section for imaging the forth bend as a light-dark-boundary by means of light irradiated from the forth light source into the forth light entry face of the forth headlight lens, wherein the forth headlight lens comprises an optical axis which is inclined with respect to said optical axis of the first headlight lens by at least 0.5°.

5. The vehicle headlight of claim 4, wherein said optical axis of the forth headlight lens is inclined with respect to said optical axis of the second headlight lens by at least 0.5°.

6. The vehicle headlight of claim 5, wherein said optical axis of the forth headlight lens is inclined with respect to said optical axis of the third headlight lens by at least 0.5°.

7. The vehicle headlight of claim 6, further comprising: an additional light source for irradiating light into said first light tunnel.

8. The vehicle headlight of claim 7, further comprising: an additional light source for irradiating light into said second light tunnel.

9. The vehicle headlight of claim 8, further comprising: an additional light source for irradiating light into said third light tunnel.

10. The vehicle headlight of claim 9, further comprising: an additional light source for irradiating light into said forth light tunnel.

11. The vehicle headlight of claim 1, further comprising: an additional light source for irradiating light directly into the second light passage section.

12. The vehicle headlight of claim 1, wherein light is irradiated, by means of the additional light source, above the light-dark-boundary.

13. The vehicle headlight of claim 1, further comprising: an additional light source for irradiating light into a surface of the second light passage section.

14. The vehicle headlight of claim 1, further comprising: a first corner light source arranged to the left of an optical axis of the first light tunnel.

15. The vehicle headlight of claim 14, further comprising: a second corner light source arranged to the right of the optical axis of the first light tunnel.

16. The vehicle headlight of claim 15, further comprising: a third corner light source arranged to the left of an optical axis of the second light tunnel.

17. The vehicle headlight of claim 16, further comprising: a forth corner light source arranged to the right of the optical axis of the second light tunnel.

18. The vehicle headlight of claim 17, further comprising: a partial light source arranged below the light tunnel of the first headlight lens.

19. The vehicle headlight of claim 1, further comprising: a first partial light source arranged below the first light tunnel.

* * * * *

UNITED STATES PATENT AND TRADEMARK OFFICE

CERTIFICATE OF CORRECTION

PATENT NO. : 8,944,649 B2
APPLICATION NO. : 13/990095
DATED : February 3, 2015
INVENTOR(S) : Dmitry Fedosik et al.

It is certified that error appears in the above-identified patent and that said Letters Patent is hereby corrected as shown below:

On the title page, item (73), the name of the Assignee should be changed from "Doctor Optics SE" to "Docter Optics SE".

Signed and Sealed this
Thirtieth Day of June, 2015

Michelle K. Lee

Michelle K. Lee
*Director of the United States Patent and Trademark Office*